US010515493B2

(12) United States Patent
Tse et al.

(10) Patent No.: US 10,515,493 B2
(45) Date of Patent: Dec. 24, 2019

(54) METHOD AND SYSTEM FOR TRACKING AND PICTORIALLY DISPLAYING LOCATIONS OF TRACKED INDIVIDUALS

(71) Applicant: Avigilon Corporation, Vancouver (CA)

(72) Inventors: King L. Tse, Vancouver (CA); Elaine Quek, New Westminster (CA); Bill Yang, Kaohsiung (TW); Steven D. Lewis, Delta (CA); Theodore W. Lepich, Jr., Baltimore, MD (US)

(73) Assignee: Avigilon Corporation, Vancouver (CA)

( * ) Notice: Subject to any disclaimer, the term of this patent is extended or adjusted under 35 U.S.C. 154(b) by 204 days.

(21) Appl. No.: 15/532,455

(22) PCT Filed: Dec. 4, 2015

(86) PCT No.: PCT/CA2015/051274
§ 371 (c)(1),
(2) Date: Jun. 1, 2017

(87) PCT Pub. No.: WO2016/086315
PCT Pub. Date: Jun. 9, 2016

(65) Prior Publication Data

US 2017/0270722 A1 Sep. 21, 2017

Related U.S. Application Data

(60) Provisional application No. 62/088,281, filed on Dec. 5, 2014.

(51) Int. Cl.
*G07C 9/00* (2006.01)
*G08B 21/18* (2006.01)

(52) U.S. Cl.
CPC ..... *G07C 9/00103* (2013.01); *G07C 9/00* (2013.01); *G07C 9/00111* (2013.01);
(Continued)

(58) Field of Classification Search
CPC .... G07C 9/00103; G07C 9/00; G07C 9/0011; G07C 9/00126; G07C 9/00158
See application file for complete search history.

(56) References Cited

U.S. PATENT DOCUMENTS 6,424,264 B1 7/2002 Giraldin et al.
8,009,013 B1 8/2011 Hirschfeld et al.
(Continued)

FOREIGN PATENT DOCUMENTS

WO WO 2007/019611 A1 2/2007
WO WO 2016/086315 A1 6/2016

OTHER PUBLICATIONS

Emerson Service Data Sheet; "Wireless Safety Mustering"; Oct. 2012; 4 pages.
(Continued)

*Primary Examiner* — Behrang Badii
*Assistant Examiner* — Daniel L Greene
(74) *Attorney, Agent, or Firm* — Daniel Hammond

(57) ABSTRACT

Methods, systems, and techniques for tracking and pictorially displaying locations of tracked individuals involve retrieving a location of the tracked individual and pictorially representing the location of the tracked individual on a display. The location can be acquired using a credentials acquisition device to read credentials issued to the tracked individuals. Pictorially representing the location on a display may involve showing one or both of the location and number of the tracked individuals on a map.

49 Claims, 18 Drawing Sheets

(52) U.S. Cl.
CPC ..... *G07C 9/00126* (2013.01); *G07C 9/00158* (2013.01); *G07C 9/00571* (2013.01); *G08B 21/18* (2013.01)

(56) References Cited

U.S. PATENT DOCUMENTS

| | | | | |
|---|---|---|---|---|
| 8,122,497 | B2 | 2/2012 | Neely | |
| 8,228,198 | B2 * | 7/2012 | McAllister | B65C 9/1865 340/10.51 |
| 8,533,814 | B2 | 9/2013 | Neely | |
| 8,868,341 | B1 * | 10/2014 | Roy, Jr. | G01S 19/17 701/482 |
| 9,509,719 | B2 | 11/2016 | Neely | |
| 2008/0030359 | A1 * | 2/2008 | Smith | G01S 13/767 340/686.1 |
| 2008/0246583 | A1 * | 10/2008 | Blake | G07C 9/00103 340/5.7 |
| 2009/0065578 | A1 | 3/2009 | Peterson et al. | |
| 2010/0282839 | A1 | 11/2010 | Zura et al. | |
| 2014/0035726 | A1 * | 2/2014 | Schoner | G06K 7/10366 340/8.1 |
| 2014/0043186 | A1 * | 2/2014 | Karayil Thekkoott | G01S 19/03 342/176 |
| 2015/0325101 | A1 * | 11/2015 | T | G07C 9/00111 340/539.13 |

OTHER PUBLICATIONS

Smart Media Innovations; "Mustering from Smart Media Innovations"; undated, obtained from website www.smi-global.co.uk on Sep. 5, 2014; 2 pages.

Nortech Control; "Roll call and muster to account for everyone during an emergency or fire drill"; undated, obtained from website www.nortechcontrol.com/access-control/what-is-access-control/access-control-in-edu . . . on Sep. 5, 2014; 2 pages.

International Search Report and Written Opinion dated Jan. 13, 2016, dated Feb. 9, 2016; issued by the Canadian Intellectual Property Office in Patent Cooperation Treaty Application No. PCT/CA2015/051274, filed Dec. 4, 2015. 8 pages.

* cited by examiner

800

*Fri, 31 Oct 2014 10:15:51 -0700* *1/1*

AREA IDENTITY REPORT

NUMBER OF RECORDS FOUND: 4

| AREA NAME | LAST NAME | FIRST NAME | LAST ACCESSED DOOR | LAST ACCESSED TIME | IDENTIFY TYPE | TOKEN INTERNAL NUMBER |
|---|---|---|---|---|---|---|
| 1 - OUTSIDE | TOKEN | a54321 | 176 - P1 - ADDR1 - DOOR4 | 2014-10-30 14:46:13 - 0700 | VISITOR | 54321 |
| 2 - LOBBY | TOKEN | a967 | 176 - P1 - ADDR0 - DOOR1 | 2014-10-30 15:52:23 - 0700 | | 967 |
| 3 - OFFICE | TOKEN | d1001 | 176 - P1 - ADDR0 - DOOR2 | 2014-10-30 15:52:23 - 0700 | EMPLOYEE | 1001 |
| 4 - LAB | TOKEN | d1697 | 176 - P1 - ADDR1 - DOOR3 | 2014-10-30 15:52:23 - 0700 | CONTRACTOR | 1697 |

FIG. 8

METHOD AND SYSTEM FOR TRACKING AND PICTORIALLY DISPLAYING LOCATIONS OF TRACKED INDIVIDUALS

CROSS REFERENCE TO RELATED APPLICATIONS

This is the U.S. National Stage of International Application No. PCT/CA2015/015274, filed Dec. 4, 2015, which was published in English under PCT Article 21(2), which in turn claims the benefit of U.S. Provisional Application No. 62/088,281, filed Dec. 5, 2014.

TECHNICAL FIELD

The present disclosure is directed at methods, systems, and techniques for tracking and pictorially displaying locations of tracked individuals.

BACKGROUND

Electronic access control systems provide the ability to control or restrict an individual's ability to enter a secured area. In order to enter the secured area, the individual presents credentials that are specific to him or her to the system. The system reads the credentials and, if valid for access to the secured area, grants the individual that access. In addition to simply granting access to the secured area, the system may also keep a record of when and where the individual presents his or her credentials to determine whether the individual is present in a particular secured area and to track the individual as he or she travels through multiple secured areas.

SUMMARY

According to a first aspect, there is provided a method for tracking and pictorially displaying locations of tracked individuals. The method comprises, for each of the tracked individuals, retrieving a location of the tracked individual and pictorially representing the location of the tracked individual on a display. The location is associated with a credentials acquisition device that has acquired credentials of the tracked individual.

Pictorially representing the location of the tracked individual may comprise displaying an indication that the tracked individual is present at the location on a map.

The map may comprise multiple areas of which each is associated with a different credentials acquisition device and/or set of credentials. The tracked individuals may be present in locations corresponding to the areas, and the indication may comprise a counting element displaying a total number of the tracked individuals in the area corresponding to the location in which the tracked individual is present.

The counting element may overlap at least part of the area corresponding to the location in which the tracked individual is present.

The map may comprise multiple areas of which each is associated with a different credentials acquisition device and/or set of credentials. The tracked individuals may be present in locations corresponding to the areas, and the indication may comprise a counting element displaying a total number of the tracked individuals in an area group comprising the area corresponding to the location in which the tracked individual is present and at least one of the other areas.

The counting element may overlap at least part of the area group.

The counting element may overlaps all of the areas comprising the area group.

The counting element may displays a total number of the individuals in the location corresponding to the area in which the tracked individual is present in addition to the total number of the individuals in the locations corresponding to the areas comprising the area group.

The counting element may display a total number of the individuals in each of the locations corresponding to the areas comprising the area group in addition to the total number of the individuals in the locations corresponding to the areas comprising the area group.

The method may further comprise acquiring the credentials of one of the tracked individuals ("acquired credentials") using the credentials acquisition device associated with one of the locations, and determining whether the tracked individual associated with the acquired credentials has committed an anti-passback violation in association with the one of the locations.

Determining whether the tracked individual associated with the credentials that have been acquired has committed an anti-passback violation may comprise determining whether the acquired credentials have been used to access the one of the locations two successive times that are separated by less than an anti-passback time limit; and when the acquired credentials have been used to access the one of the locations two successive times that are separated by less than the anti-passback time limit, determining that the anti-passback violation has been committed.

Determining whether the tracked individual associated with the credentials that have been acquired has committed an anti-passback violation may comprise determining whether the acquired credentials have been used to access the one of the locations two successive times; and when the acquired credentials have been used to access the one of the locations two successive times, determining that the anti-passback violation has been committed.

Determining whether the tracked individual associated with the credentials that have been acquired has committed an anti-passback violation may comprise determining whether the acquired credentials have been used to access and to subsequently exit the one of the locations, and whether the acquired credentials have not been used to re-enter the one of the locations since being used to exit the one of the locations; and when the acquired credentials have not been used to access and to subsequently exit the one of the locations, and when the acquired credentials have not been used to re-enter the one of the locations since being used to exit the one of the locations, determining that the anti-passback violation has been committed.

Each of the locations may be accessible via an access point, and the method may further comprise when the anti-passback violation has been determined to have been committed, preventing the tracked individual from entering the one of the locations via the access point.

The method may further comprise receiving a request from a client to de-muster one of the tracked individuals ("de-mustered individual"); and de-mustering the de-mustered individual by receiving from the credentials acquisition device a request by the de-mustered individual to enter the one of the locations; and permitting the de-mustered individual to enter the one of the locations notwithstanding the anti-passback violation.

The de-mustering may further comprise decrementing the counting element displayed on the map for the de-mustered individual by one.

The credentials acquisition device may comprise a muster station in one of the locations.

The method may further comprise receiving a request from a client for more particular information about any one or more of the tracked individuals present in any one of the locations; retrieving the more particular information; and displaying, on the display, a listing comprising the more particular information.

The request may comprise a selection of the indication via a user interface.

The more particular information may comprise a name of each of the any one or more tracked individuals.

The more particular information may comprise a last badged location of the tracked individual, the last badged location of the tracked individual comprising the location associated with the credentials acquisition device that last acquired the credentials of the tracked individual.

The more particular information may comprise a last badged time of each of the tracked individuals, the last badged time comprising the time at which the last badged location was acquired.

At least some of the locations may comprise physically enclosed spaces.

At least some of the locations may comprise non-physically enclosed spaces.

The map may comprise a three dimensional rendering of a building.

A non-counting element may be displayed on the map. The non-counting element may provide information other than how many of the tracked individuals are present in any of the locations.

According to another aspect, there is provided a system for tracking and pictorially displaying locations of tracked individuals. The system comprises an access controller; a credentials acquisition device communicatively coupled to the access controller and operable to acquire credentials of the tracked individuals; and a non-volatile memory communicatively coupled to the access controller and having stored thereon the credentials of the tracked individuals and a location associated with the credentials acquisition device. The access controller is configured to perform a method comprising, for each of the tracked individuals, retrieving, as a location of the tracked individual, the location associated with the credentials acquisition device that has acquired the credentials of the tracked individual; and pictorially representing the location of the tracked individual on a display that is communicatively coupled to the access controller.

Pictorially representing the location of the tracked individual may comprise displaying an indication that the tracked individual is present at the location on a map shown on the display.

The map may comprise multiple areas of which each is associated with a different credentials acquisition device and/or set of credentials. The tracked individuals may be present in locations corresponding to the areas, and the indication may comprise a counting element displaying a total number of the tracked individuals in the area corresponding to the location in which the tracked individual is present.

The counting element may overlap at least part of the area corresponding to the location in which the tracked individual is present.

The map may comprise multiple areas of which each is associated with a different credentials acquisition device. The tracked individuals may be present in locations corresponding to the areas, and the indication may comprise a counting element displaying a total number of the tracked individuals in an area group comprising the area corresponding to the location in which the tracked individual is present and at least one of the other areas.

The counting element may overlap at least part of the area group.

The counting element may overlap all of the areas comprising the area group.

The counting element may display a total number of the individuals in the location corresponding to the area in which the tracked individual is present in addition to the total number of the individuals in the locations corresponding to the areas comprising the area group.

The counting element may display a total number of the individuals in each of the locations corresponding to the areas comprising the area group in addition to the total number of the individuals in the locations corresponding to the areas comprising the area group.

The access controller may be further configured to determine whether the tracked individual associated with the acquired credentials has committed an anti-passback violation in association with the location associated with the anti-passback device.

The access controller, to determine whether the anti-passback violation has been committed, may be further configured to determine whether the acquired credentials have been used to access the location two successive times that are separated by less than an anti-passback time limit; and when the acquired credentials have been used to access the location two successive times that are separated by less than an anti-passback time limit, determine that the anti-passback violation has been committed.

The access controller, to determine whether the anti-passback violation has been committed, may be further configured to determine whether the acquired credentials have been used to access the locations two successive times; and when the acquired credentials have been used to access the locations two successive times, determine that the anti-passback violation has been committed.

The access controller, to determine whether the anti-passback violation has been committed, may be further configured to determine whether the acquired credentials have been used to access and to subsequently exit the location, and whether the acquired credentials have not been used to re-enter the location since being used to exit the location; and when the acquired credentials have not been used to access and to subsequently exit the location, and when the acquired credentials have not been used to re-enter the location since being used to exit the location, determine that the anti-passback violation has been committed.

The location may be accessible via an access point, and the access controller may be further configured to, when the anti-passback violation has been determined to have been committed, prevent the tracked individual from entering the one of the locations via the access point.

The access controller may be communicative with a client, and in response to a request from the client to de-muster one of the tracked individuals ("de-mustered individual"), may de-muster the de-mustered individual by permitting the de-mustered individual to enter the location notwithstanding the anti-passback violation.

The access controller may be further configured to decrement the counting element displayed on the map for the de-mustered individual by one.

The credentials acquisition device may comprise a muster station in one of the locations.

The access controller may be communicative with a client, and in response to a request from the client for more particular information stored on the non-volatile memory about any one or more of the tracked individuals present in any of the locations, may retrieves the more particular information from the non-volatile memory; and display, on the display, a listing comprising the more particular information.

The request may comprise a selection of the indication via a user interface.

The more particular information may comprise a name of each of the any one or more tracked individuals.

The more particular information may comprise a last badged location of the tracked individual, the last badged location of the tracked individual comprising the location associated with the credentials acquisition device that last acquired the credentials of the tracked individual.

The more particular information may comprise a last badged time of each of the tracked individuals, the last badged time comprising the time at which the last badged location was acquired.

At least some of the locations may comprise physically enclosed spaces.

At least some of the locations may comprise non-physically enclosed spaces.

The map may comprise a three dimensional rendering of a building.

A non-counting element may be displayed on the map. The non-counting element may provide information other than how many of the tracked individuals are present in any of the locations.

The system may further comprise the client and the display.

According to another aspect, there is provided a non-transitory computer readable medium having encoded thereon computer program code that, when executed by a controller, causes the controller to perform any aspects of the method described above and suitable combinations thereof.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more example embodiments:

FIG. 8 is an example area identity report showing the various areas monitored by the access control system of FIGS. 1A-1C and the tracked individuals who are present in those areas.

DETAILED DESCRIPTION

Figure 1A:
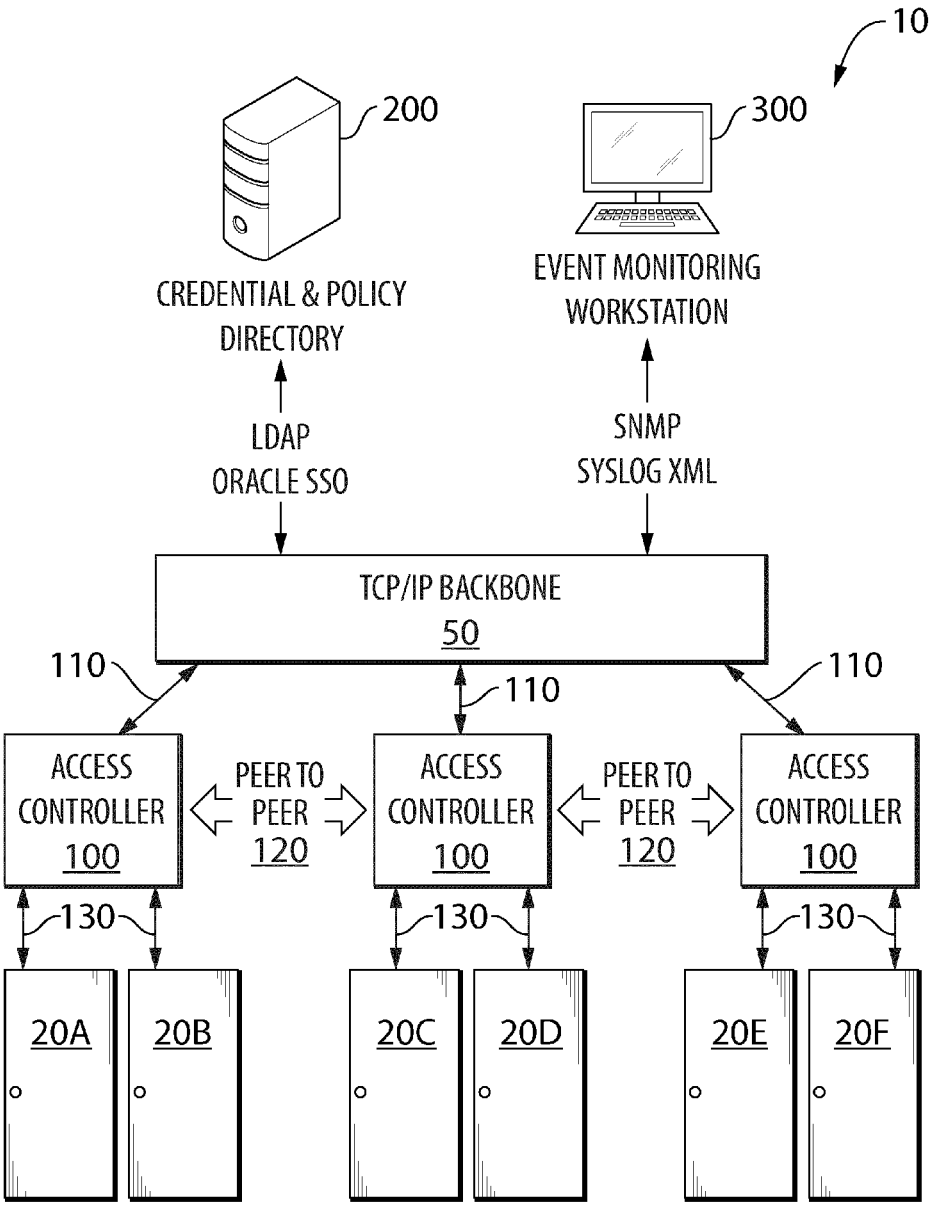
FIGS. 1A-1C illustrate an example access control system and select components thereof according to one embodiment.

Directional terms such as "top", "bottom", "upwards", "downwards", "vertically", and "laterally" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", and "coupling" as used in this description are intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections.

As used herein, "A and/or B" means "one or both of A and B".

Ensuring that only authorized individuals access protected or secured areas may be crucially important (e.g., at an airport, a military installation, office building etc.). Protected or secured areas may be defined by physical doors (e.g., doors through which a human may enter) and walls, or may be virtually defined in other ways. For instance, a protected area may be defined as one in which unauthorized entry causes a detector to signal intrusion and optionally send a signal or sound an alarm either immediately or if authorization is not provided within a certain period of time. As another example, a secured area may be virtually defined as a directory of a filing system on a computer that requires the user of that computer to possess a certain clearance prior to being granted access to that directory.

Access control systems may limit entry into protected or secured areas of buildings, rooms within buildings, real property, fenced-in regions, or assets and resources therein, to only those individuals who have permission to enter.

Thus, an access control system should identify the individual attempting to enter the secured area, which may comprise an attempt to access assets, and verify the individual is currently authorized to enter. Described herein are access control systems, devices, and methods that may encompass any suitable access technology, such as the following:

1. using PINs and passwords that can be entered at a key pad associated with the access point (e.g., a door);
2. using biometrics that can be entered by individuals via special readers associated with the access point;
3. using traditional signatures, provided by the individuals via a special pad associated with the access point;
4. using smart cards or contactless cards (e.g., sending a PIN to the access point via a special reader/receiver);
5. using a digital certificate (e.g., one stored in a smart card, contactless card or a wireless device) that can "communicate to the access point" via a card reader or other receiver; and
6. using a physical key inserted into a lock for the access point; such a key/lock mechanism may include a special encoding on the key that is read in the lock.

The above list of access technologies is not meant to be exhaustive. Furthermore, some facilities may use combinations of these technologies. The technologies may be used in any environment, including in government facilities, private businesses, public facilities, and in an individual's home.

As a further explanation of some of the above access technologies, some current access control systems use doors equipped with an entry device such as a key pad, through which an individual enters a PIN or password. The key pad has an attached memory or elementary processor in which a list of valid PINS/passwords is stored, so that the PIN/password may be checked to determine whether it still is valid. If the PIN/password is valid, the door opens; otherwise the door remains locked. Such elementary access control mechanisms offer relatively minimal security. For example, a terminated employee may no longer be authorized to go through a door; however, a terminated employee who remembers his PIN still may be able to open the door. Therefore, it would be necessary to "deprogram" the PIN of terminated employees. Such a procedure, however, may be very cumbersome and costly: a facility may have hundreds of doors, and deprogramming all such doors whenever an employee leaves or is terminated may be impractical.

Some current card-based access control systems use radio frequency identification (RFID) technology. The access card reader includes an RFID transceiver, and the access card includes an RFID tag or transponder. The RFID transceiver transmits a radio frequency (RF) query to the card as the card passes over the RFID transceiver. The RF transponder includes a silicon chip and an antenna that enables the card to receive and respond to the RF query. The response is typically an RF signal that includes a pre-programmed identification (ID) number. The card reader receives the signal and transmits the ID number to a control panel using a wired or wireless connection. Current card readers may perform some basic formatting of the identification data prior to sending the data to the control panel, but generally are unable to perform higher level functions.

In addition to provisioning/de-provisioning access to assets such as physical areas, the access controllers, systems, and methods disclosed herein also may provision a user/credential identity store with logical privileges to provide access to logical assets or resources such as files, computing resources, or other computing systems. Furthermore, access to the logical assets or resources may vary depending on the physical location of the individual requesting such access.

The access controllers, control systems, and control methods are described below with reference to the following terms:

1. Access controller: a device programmed to make access decisions based on a cached database supplied by an identity store. Access requests are made via a sensing device (card reader, push button, etc.); authorization is checked either locally or by referring to a remote identity store for processing. If an access request is approved, output and input devices/systems (e.g., entry doors) are manipulated to allow access.
2. Door controller: a device in communication with the access controller and one or both of wired and wirelessly communicative with a credential reader and associated input and output hardware. The door controller sends changes of state and credential reads to the access controller, waits for an authorization response from the access controller, and commands attached input, output, and credential readers according to the authorization response.
3. Browser: a software program used to access and display Internet Web pages; example browsers include Internet Explorer™, Google Chrome™, Mozilla Firefox™, and Apple Safari™.
4. Identity store (or directory): a database including relational, hierarchical, networked or other architectures that includes authorization and authentication data for individuals, credentials, resources, and group memberships. The identity store may reside at a facility owned and operated by an entity different from the entity owning and/or operating the protected area.
5. Event aggregation: the ability of the access controller to store and forward, to multiple systems, events that occur or are generated in the course of operating the access controller.

In an embodiment, the access controller comprises a computer comprising a processor and a non-transitory computer readable medium communicative with the processor, with the non-transitory medium having stored thereon computer program code that, when executed by the processor, causes the access controller to perform one or more of the methods described herein, or suitable combinations thereof. The computer may run, for example, the Linux™ operating system. The computer may be designed for desktop, rack mountable, cloud based, or embedded use. In one embodiment, the computer provides the necessary processor, storage, and connectivity for the computer program code and all required computer program code is loaded onto the computer without requiring any installation onto any other computer system. In another embodiment, the computer may comprise one or more processors networked with one or more computer readable media, and the computer program code and/or execution thereof may be performed in a distributed manner across more than one of the processors.

The access controller provides an improved way to maintain credentials and associated access privileges and to transmit in real time events using an existing information technology (IT) infrastructure and databases without the need to access or otherwise use proprietary communication protocols.

The access controller, as a self-provisioning access device, may obtain and maintain a cached list of credentials and associated access privileges; these data allow the access controller to make on-the-spot, real-time access decisions without communication to any other access control system(s). The cache of credentials and associated access privileges may be acquired from one or more host systems periodically, including on a schedule, in real time, or as a complete snapshot. For example, the access controller may, in effect, continuously access a host system directory of access credentials and associated access privileges, and download some or all of the credentials and privileges. In an embodiment, the access controller downloads these data for a select number of individuals. An individual for whom the data are downloaded may be uniquely identified, identified by group association, or identified by assigned roles(s).

The access controller may be used in either real-time (on demand) or on a schedule, to send real time events to a logging and monitoring device or system. In one example embodiment, an event may be an access door unlocking or locking, an access door open or closed signal (e.g., from a limit switch or position sensor, or based on a logic routine), an access door fault or unusual operation (open for a time exceeding a variable threshold), etc. The events may be sent in any number of formats, including XML, directly into a relational database or system logging facility of any number of remote devices or systems. If connectivity is lost, the access controller may buffer the events and may continue event transmission when connectivity is re-established.

The access controller may comprise or provide a browser-accessible user interface. The interface provides an access control system operator the ability to configure any number of access points (e.g., doors) and their operation, and associated mapping to individuals and/or groups (on an individual basis, group basis, and/or defined role basis) to convey access privileges. With the same interface, the operator may configure the access controller to communicate with credential sources, including credential sources implemented in or using a relational database, a directory or hierarchical data store, flat files such as comma-separated value (CSV) file, any common ASCII file, a unicode file, or any suitable text file.

With the interface, the operator selects and configures a type of data synchronization including timed intervals, scheduled, on-demand, and real-time. The synchronization methods may include subscription, in which a host access credentials and policy system "pushes" information changes to the access controller; audit trail, in which the access controller requests information updates; or data modification triggers, in which code written into the host system detects information changes and sends the changed information to the access controller. The subscription method may require a persistent, always-on connection between the host system and the access controller while the other example two methods may use a transient connection.

The access controller initiates connection(s) to the sources and retrieves the credential and policy information to build the controller's local cache. Each individual may have a unique identifier to collate the individual's information from multiple sources into a single record. Once transferred to the local cache, the information may be used in access decisions as credentials are presented at access control points.

The access controller may log events, and the logs may be configured with the user interface to establish any number of devices, services, and systems as event recipients. The access controller may send the events to a remote monitoring service in any number of formats including, for example, SNMP, XML via direct socket connection (GSM, LAN, WAN, WiFi), Syslog, and through a serial port.

The access controller may be used to assign priorities to events. The event priorities may determine which events, and in what order, those events are sent to the remote monitoring service. Alternatively or additionally, the event priorities may determine how the remote monitoring service displays those different events. For example, the events having a relatively high priority may be displayed in an attention attracting manner, such as by using bright colors or large or flashing text, compared to events having relatively low priority.

Figure 1B:
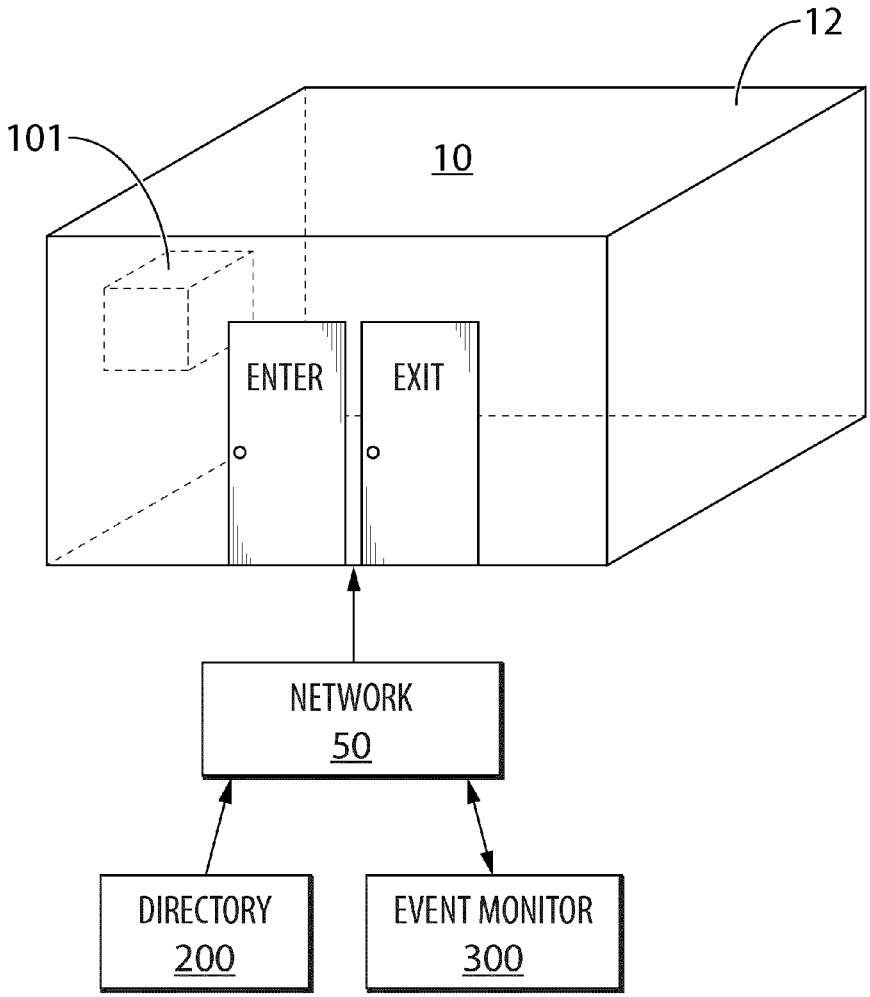
Figure 1C:
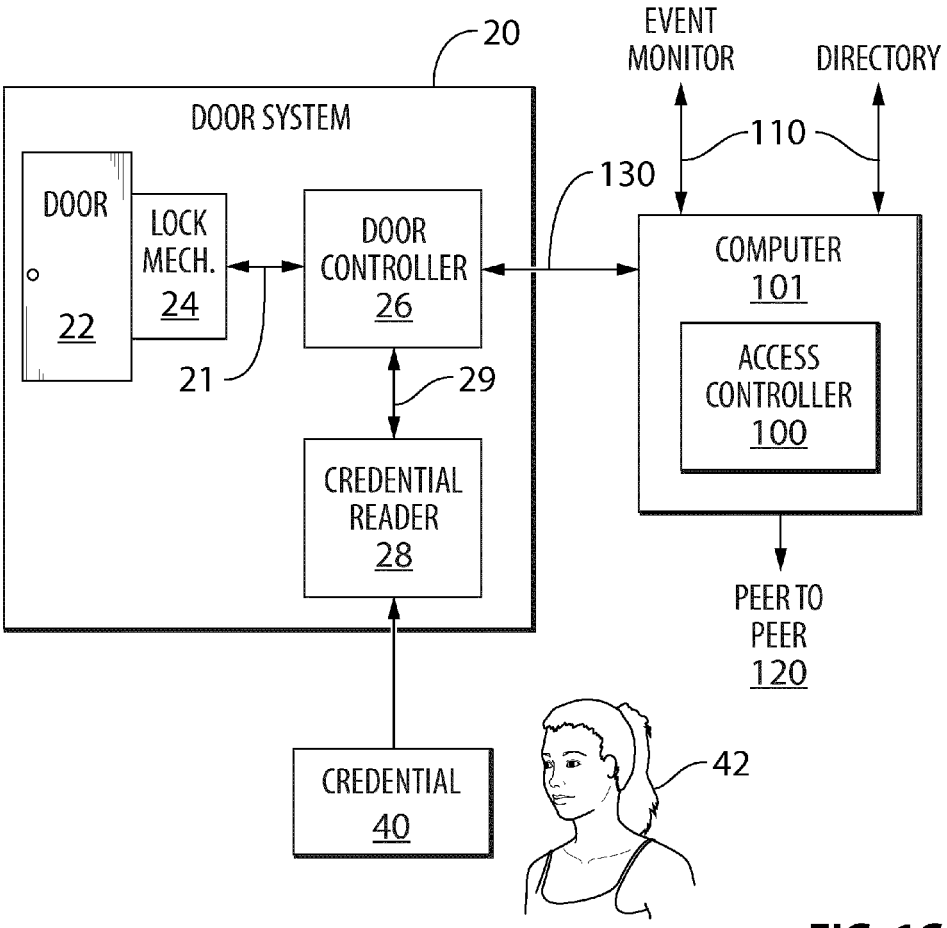

FIGS. 1A-C illustrate an example access control system 10 and select components thereof. In FIG. 1A, the access control system 10 includes door systems 20, access controllers 100, a credential and policy directory 200 and event monitoring workstation 300, all of which are intended to limit or control access to an area or volume. The controllers 100 communicate 110 with the directory 200 and workstation 300 using, for example, a TCP/IP backbone 50. The TCP/IP backbone 50 may be wired or wireless, or a combination of wired and wireless. The backbone 50 may include elements of a local area network (LAN) and a wide area network (WAN), including the Internet. Communications 110 between the access controller 100 and the directory 200, and between the controller 100 and the workstation 300 may be secure communications (e.g., HTTPS communications).

FIG. 1B illustrates selected components of the access control system 10 to limit or control access by individuals to an enclosed area 12. As shown, the enclosed area 12 is a six-sided structure with an entry door system 20 and an exit door system 20. The door systems 20 are described with reference to FIGS. 1A and 1C. The door systems 20 are intended for normal human access. Other access points (e.g., windows) may exist, and their operation may be monitored, alarmed, and controlled, but such access points are not described further herein. As used in this description, a reference to the area 12 may be a reference to a physical location or to an area on a map that corresponds to that physical location, as used in the context of FIG. 2.

The enclosed area 12 includes a computing platform 101 on which are implemented access control features that control, monitor, and report on operation of the door systems 20. The computing platform 101 may be fixed or mobile. The computing platform 101 is shown inside the enclosed area 12 but need not be. In executing its control, monitoring, and reporting functions, the computing platform 101 with its access control features may communicate external to the enclosed area 12 by way of a network 50 with the (remote) directory 200 and with (remote) event monitoring workstation 300. The network 50 may be wired and/or wireless, and may provide for secure communications and signaling in addition to non-secure communications and signaling.

The enclosed area 12 may be a room in a building, the building itself, or any other structure. The enclosed area 12 is not limited to a six-sided configuration. The enclosed area 12 could be an open structure (e.g., a sports stadium), a fenced-in area (e.g., an area surrounding a runway), or an area having an "invisible" fence or "virtual walls." The enclosed area 12 may be geographically fixed (e.g., a building, a room in a building) or mobile (e.g., a trailer, airplane, ship, or container).

The enclosed area 12 may be used to control access to government and/or business premises, classified documents and/or devices contained therein, access to computer systems contained therein, access to individuals, access to valuable items such as rare paintings, jewelry, etc., and access to dangerous materials or systems. The enclosed area 12 may, for example, be a safe or vault at a bank, a control room for a nuclear reactor, a hangar for a classified, new-technology airplane, or a passenger gate at an airport.

In a mobile configuration, the enclosed area 12 may be used, for example, in field operations to quickly establish a secure facility anywhere in the world. The security of such a mobile enclosed area 12 will be apparent from the discussion that follows. Moreover, the mobile enclosed area 12 may be used for very different operations, with different individuals able to access the mobile enclosed area 12, depending on its intended use, by configurations changes implemented through a user interface, as described below. Thus, the access control system 10 provides not only high levels of security, access control, event monitoring, and reporting, but also the flexibility to quickly adapt the mobile enclosed area 12 to any operation or mission, anywhere in the world, for which access control is desired.

Returning to FIG. 1A, the access controllers 100 also may communicate between and among themselves using peer-to-peer communications 120. Such peer-to-peer communications 120 may be enabled by use of a secure LAN, for example. Alternately, the peer-to-peer communications 120 may be wireless secure communications. The peer-to-peer communications 120 also may follow the TCP/IP protocol.

The peer-to-peer communications 120 allow an access controller 100 to send and receive access status information and events to and from the other access controllers 100 used in the enclosed area 12. Thus, if a door system 20 is inoperative, its associated access controller 100 may provide this information to the other access controllers 100. The peer-to-peer communications 120 allow one access controller 100 to act as a parent (master) access controller and the remaining access controllers 100 to act as child (subservient) access controllers. In this aspect, information and configurations may be stored or implemented on the parent access controller and then may be replicated on the child access controllers.

The access controller 100 may communicate with the door systems 20 using wired and/or wireless secure communications 130.

The door systems 20, which are described in more detail with reference to FIG. 1B, control normal human access to an enclosed area 12. In the example of FIG. 1A, six door systems 20 are illustrated. In an embodiment, the six door systems 20 provide three enclosed area access points, and the door systems 20 operate in pairs; one door system 20 of a pair allows entry into the enclosed area 12 and the other door system 20 of the pair allows egress from the enclosed area 12. In another embodiment, a single door system 20 may be used for both entry to and egress from the enclosed area 12.

FIG. 1A shows each door system pair in communication with a separate access controller 100. However, other combinations of controllers 100 and door systems 20 may be implemented in the access control system 10. For example, a single controller 100 may control all door systems 20 for the enclosed area 12.

The credential & policy directory 200 shown in FIG. 1A may represent one or many actual directories. The directories may be located remotely from the enclosed area 12. The directories may be operated by entities other than the operator of the enclosed area 12. For example, the enclosed area 12 may be a sensitive compartmented information facility (SCIF) for a government contractor, and the directory 200 may represent a directory for the government contractor and a directory for a government agency.

A directory 200 may include identification information (e.g., name, age, physical characteristics, photograph) for individuals who may be allowed access to the enclosed area 12, the identification credentials of the individuals (e.g., PIN/password, RFID tag, certificate), and other information.

The event monitoring workstation 300 may be implemented by the same entity as that of the enclosed area 12. Alternatively, the event monitoring workstation 300 may be implemented by and at an entity separate and apart from that of the enclosed area 12.

The event monitoring workstation 300 may receive event data from the access controllers 100.

FIG. 1C illustrates an example door system that may be implemented in the system of FIG. 1A. In FIG. 1C, the door system 20 is shown in communication with the access controller 100 over the communication path 110. The door system 20 includes the access door 22, door locking mechanism 24, door controller 26, and credential reader 28. The door 22 may be any door that allows individuals to enter or leave the enclosed area. The door 22 may include a position sensor (e.g., a limit switch, which is not shown) that indicates when the door 22 is not fully closed. The position sensor may send a not-fully-closed signal over the signal path 21 to the door controller 26. The not-fully-closed signal may be sent continuously or periodically, and may or may not be sent until after a predefined time has expired.

The locking mechanism 24 includes a remotely operated electro-mechanical locking element (not shown) such as a dead bolt that is positioned (locked or unlocked) in response to an electrical signal sent over the signal path 21 from the door controller 26.

The door controller 26 receives credential information over the signal path 29 from the credential reader 28 and passes the information to the access controller 100 over another signal path 130. The door controller 26 receives lock/unlock signals from the access controller 100 over the signal path 130. The door controller 26 sends lock mechanism lock/unlock signals over the signal path 21 to the locking mechanism 24.

The credential reader 28 receives credential information 40 for an individual 42. The credential information 40 may be encoded in an RFID chip, a credential on a smart card, a PIN/password input using a key pad, and biometric data such as fingerprint and retina scan data, for example.

The door system 20 operates based on access request signals sent to the access controller 100 and access authorization signals received, in response, from the access controller 100. The door system 20 may incorporate an auto lock feature that activates (locks) the door 22 within a specified time after the door 22 is opened and then shut, after an unlock signal has been sent to the locking mechanism 24 but the door 22 not opened within a specified time, or under other conditions. The auto lock logic may be implemented in the door controller 26 or the locking mechanism 24.

The door system 20 may send event signals to the event monitoring system 300 by way of the access controller 100. Such signals include door open, door closed, locking mechanism locked, and locking mechanism unlocked. As noted above, the signals may originate from limit switches in the door system 20.

In one example embodiment, a door system 20 may be used only for entry and a separate door system 20 may be used only for egress.

However configured, the door systems 20 may trigger the event that indicates when an individual 42 enters the enclosed area 12 and when the individual 42 has exited the enclosed area 12, based on information obtained by reading credential information 40 of the individual 42 on entry and exit, respectively. These signals may be used to prevent reentry without an intervening exit, for example. The presence or absence of these signals also may be used to prevent access to areas and systems within the enclosed area. For example, the individual 42 may not be allowed to log onto his computer in the enclosed area 12 in the absence of an entry signal originating from one of the door systems 20 of the enclosed area 12. Thus, the access controller 100 and its implemented security functions may be a first step in a cascading series of access operations to which the individual may be exposed.

The door systems 20 may incorporate various alarms such as for a propped open door 22, a stuck unlocked locking mechanism 24, and other indications of breach or fault.

FIGS. 1A-1C describe an access control system 10 primarily as applying to physical access to an area such as a building or a room in the building. However, the access control system 10, and select components thereof, as disclosed above, may be used to control access to an organization's assets and resources, including logical resources. For example, the access controller 100 may be used to control access to an organization's computer system and to the files (i.e., logical resources) contained on the computer system. Moreover, the access controller 100 may self-provision to provide individuals with staged access to the logical resources. For example, an individual may be allowed access to files 1-10 in a first enclosed area, and access to files 1-20 in a second, and more secure, enclosed area. In this example, the first enclosed area may be a building and the second enclosed area may be a SCIF within the building. Thus, the access controller 100 may establish very fine control over access privileges for individuals, including physical and logical access, and may adjust the logical access based on the physical location of the individual as indicated by a read of the individual's credentials.

Figure 2:
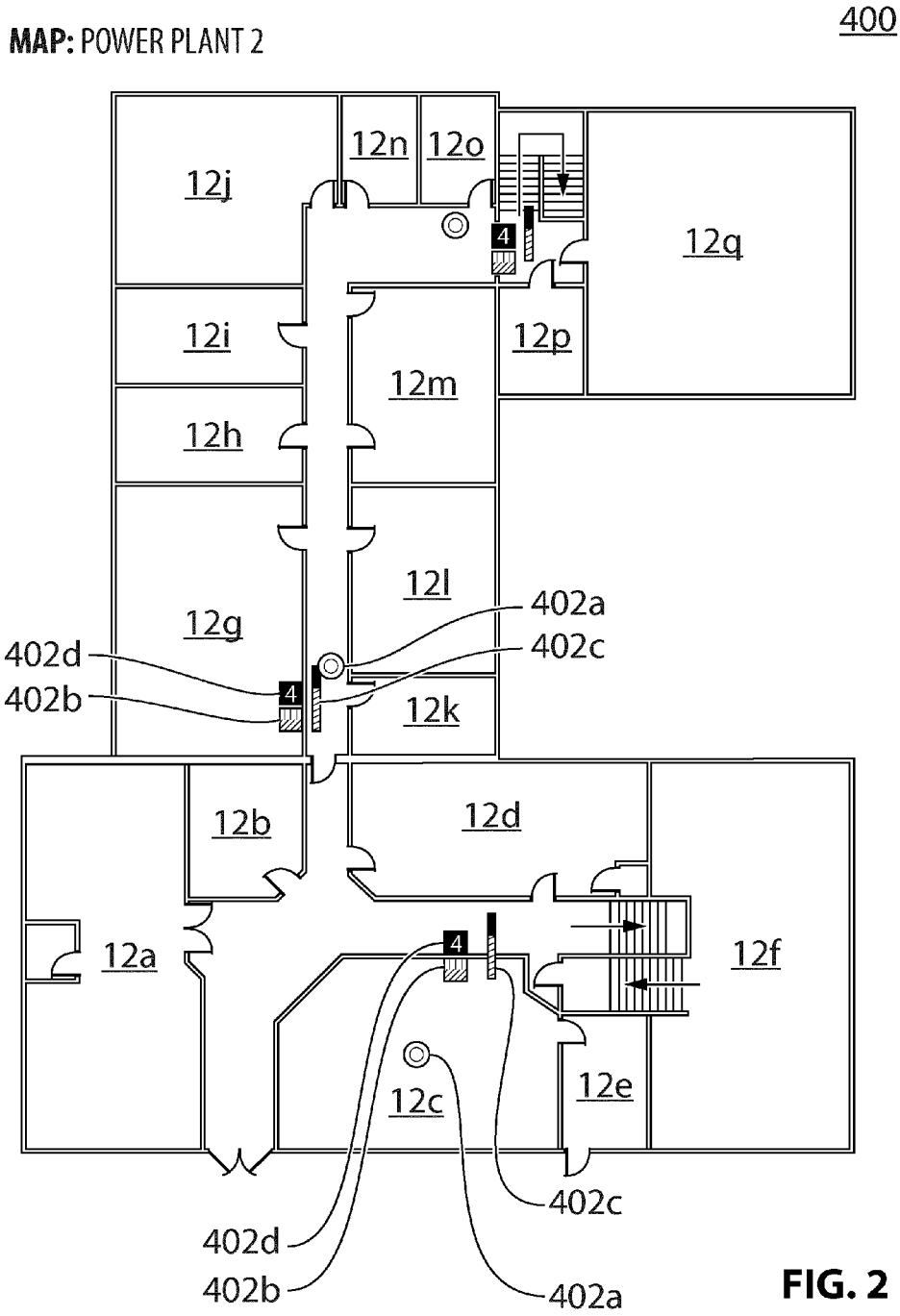
FIG. 2 is a map, showing cameras and doors, that can be shown on a workstation of the system of FIG. 1.

The access control system 10 may also be used to track individuals who access the enclosed area 12 using the credentials 40 in a process referred to as "mustering". Mustering comprises using an individual's credentials 40 to determine whether that individual is within one of the enclosed areas 12 monitored by the access control system 10, and if so, which of the enclosed areas 12 that is. Referring now to FIG. 2, there is shown a map 400 of various areas 12*a-q* that each requires an individual to present his or her credentials 40 prior to gaining access to that area 12*a-q*. The access controller 100 may monitor multiple of these tracked individuals and display the map 400 on the workstation 300. As discussed in more detail below, by providing mustering functionality the controller 100 permits an operator of the access control system 10 to track who is currently present within the areas 12 in real-time. In the event of an emergency that endangers the personal safety of those within the areas 12, the operator can use the mustering information to direct first responders to provide aid to those still within the areas 12 and who may consequently be in danger. Once the emergency has passed and all tracked individuals have been accounted for, they may move freely or return to their designated areas 12 as discussed in more detail with respect to "de-mustering", below.

In the depicted embodiments, the map 400 is a two-dimensional, pictorial representation of a real world location. In alternative embodiments, however, the two-dimensional map 400 may be replaced with a different type of pictorial representation. For example, the map 400 may be rendered in three dimensions and represent an entire building as opposed to a floorplan of one floor of the building. More generally, the map 400 may be replaced with any pictorial representation of a real world location, such as one or more buildings, one or more floors of a building, a bank vault, a power plant, a room, an office tower, and portions thereof.

Figure 12:
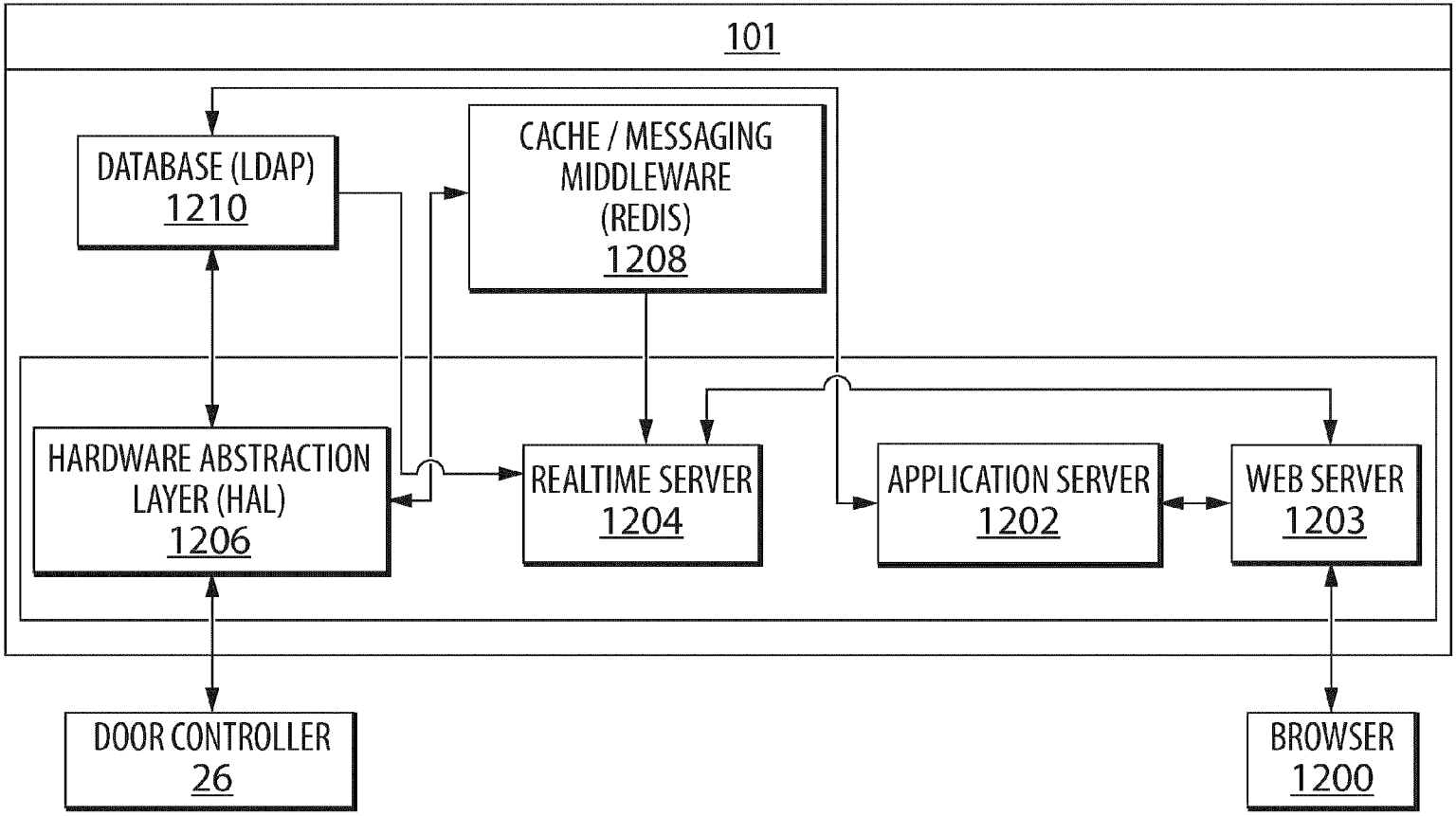
FIG. 12 is a block diagram of a computing system comprising an access controller, which comprises part of the access control system of FIG. 1.

Referring now to FIG. 12, there is shown a block diagram of the computing platform 101, according to one embodiment. The computing platform comprises a database 1210, messaging middleware 1208, and the controller 100. The controller 100 comprises a hardware abstraction layer 1206 (HAL) communicative with the door controller 26, a real-time server 1204 (referred to as an "RT server" in FIGS. 13, 14, and 16), application logic running on an application server 1202, and a web server 1203. The HAL 1206 is communicative with the door controller 26. The web server 1203 is communicative with a browser 1200 that is resident on the workstation 300, and the web server 1203 is also communicative with the application and realtime servers 1202,1204. During typical operation of the access control system 10, the browser 1200 communicates with the web server 1203, which relays the majority of requests and communications to the application server 1202, and the application server 1202 responds to the browser 1200 via the web server 1203. The web server 1203 relays some requests from the browser 1200 to the realtime server 1204. The browser 1200 establishes a connection to the realtime server 1204 via the web server 1203, and the realtime server 1204 subsequently uses this connection to push data to the browser 1200 in real time as opposed to having the browser 1200 periodically poll for new data; examples of this pushed data include token counts for various areas 12, as discussed in more detail below.

In one example embodiment the web server 1203 may be an Nginx server configured to have both web server and reverse proxy functionality, but in alternative embodiments the web server 1203 may comprise a different type of server.

The database 1210 is communicative with the application server 1202, the HAL 1206, and the realtime server 1204. The middleware 1208 sends messages to the realtime server 1204 and is also communicative with the HAL 1206. The database 1210 may, for example, be a lightweight directory access protocol (LDAP) database. The middleware 1208 may, for example, be a Redis data structure server that also serves as a fast, in-memory cache as well as messaging middleware that implements a publish/subscribe messaging system.

While the browser 1200 is shown in FIG. 12, in alternative embodiments (not depicted) a different type of client interface may be used to interface with the operator. For example, an interface may be via a native application running on the workstation 300. Furthermore, the workstation 300 may be replaced with any suitable type of client device that permits the operator to interface with the remainder of the access control system 10, such as a general purpose computer, a smart phone, or a tablet computer.

Stored in the database 1210 are records including information such as a list of the credentials 40 associated with the tracked individuals, identification information for the tracked individuals, and information regarding which of the credentials 40 have been assigned to which of the tracked individuals. In FIG. 12, the database 1210 comprises part of the computing system 101 and interfaces with the credential & policy directory 200. In one example embodiment, the computing system 101 comprises part of an appliance that a customer may purchase and install into an existing security infrastructure. The computing system 101 is able to interface with the directory 200 and import or access as required any relevant information stored in the directory 200. For example, upon installation and periodically thereafter the computing system 101 may download from the directory 200 and into the database 1210 all credential-related information stored in the directory 200 for use as described below.

While the computing system 101 of FIG. 12 uses the middleware 1208, in alternative embodiments (not depicted) the middleware 1208 may be omitted. For example, instead of the middleware 1208 the controller 100 may employ an in-memory cache. Furthermore, even in embodiments in which the middleware 1208 is present, it need not comprise a Redis server.

When an individual presents credentials 40 to a credentials acquisition device such as the credentials reader 28, the reader 28 reads a token from the credentials 40 and transmits the token to the door controller 26, which in turn relays the token to the controller 100. Once the HAL 1206 receives the token, the controller 101 generates and logs transaction data. The transaction data comprises the token, the location (in terms of one of the areas 12) secured by the credentials reader 28 that obtained the token, and a date and time stamp of when the credentials reader 28 read the token. This transaction data is sent to the database 1210 where the identity of the tracked individual associated with the token is retrieved and logged with the transaction data. The token counts in the middleware 1208 are subsequently updated, and the middleware 1208 pushes the token count for each of the areas 12 to the realtime server 1204 for transmission to and display on the workstation 300 via the browser 1200. In this way the database 1210 and the middleware 1208 store up-to-date data regarding which tokens are associated with which areas 12, which corresponds to which tracked individuals are located in which areas 12.

In FIG. 2, each of the areas 12*a-q* is a room of a power plant, and the map 400 is the floor plan of the power plant. However, in alternative embodiments (not depicted) and as described above, the areas 12*a-q* need not be rooms and need not be physically segregated from each other. Furthermore, in alternative embodiments (not depicted) and as alluded to above the map 400 need not be a floor plan of a building and may be any suitable pictorial representation of the areas 12. For example, the map 400 may graphically represent an open structure (e.g., a sports stadium), a fenced-in area (e.g., an area surrounding a runway), an area having an "invisible" fence or "virtual walls", a trailer, an airplane, a ship, a container, a factory, an industrial area, a power plant, or a chemical plant.

The controller 100 permits the operator of the access control system 10 to monitor security related events using the map 400. A "security related event" that the access control system 10 can monitor may be any event that the access control system 10 can detect using one or both of its hardware and software or those events fed to it from external systems. A security related event may, for example, be any of the doors opening or closing, the lock on any of the doors being tampered with, a certain number of people being in one of the areas 12, an unauthorized entry via any access point such as a door or window, motion detected by a camera, power failure on hardware connected to or comprising part of the access control system 10, computer network activity, feeds from external systems that are interfaced with the access control system 10, an operator of the access control system 10 logging into or accessing the access control system 10, and an operator of the access control system 10 accessing or changing certain data that the access control system 10 stores, such as data in the database 1210 relating to locations of tracked individuals.

The map 400 of FIG. 2 comprises multiple map elements 402*a,b,c,d* (collectively, "map elements 402") and, in particular, a camera 402*a*, a door 402*b*, a color-coded door status indicator 402*c* (e.g., to indicate whether the door is currently communicating, locked, powered, has been tampered with, is low on battery power, has been forced open, or is being held open), and an alarm indicator 402*d*; other examples of map elements 402 are panels, subpanels, inputs, outputs, zoom controls, and global actions. A map element 402 is any element that may be displayed on or otherwise in association with the map 400, and is divided into two subsets: "non-counting elements" that do not provide information to the operator of the access control system 10 about how many tracked individuals are present in any one or more of the areas 12, and "counting elements" that do provide this information. Instead of providing information to the operator about the number of tracked individuals, the non-counting elements may provide information on the status of the access control system 10, such as with the door status indicator 402*c* described above, or may be able to receive input from the operator to cause the access control system 10 to perform a certain action such as activate or deactivate a camera. The map elements 402 may or may not be interactive. As an example of an interactive map element 402, the operator of the access control system 10 may select the alarm indicator 402*d* to bring up a list of the currently pending alarms, such as the list shown in FIG. 3. The operator is able to customize the map 400 with various map elements 402 in accordance with the example methods 900,1000 shown in FIGS. 9 and 10 and the example interfaces 600,702,704 of FIGS. 5, 6A, and 6B.

Figure 9:
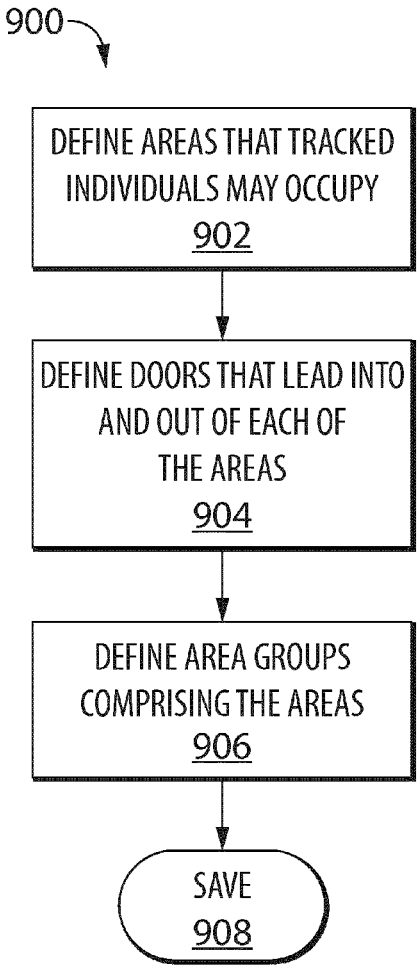
FIGS. 9 and 10 show flowcharts depicting example methods for configuring the map of FIG. 2 to display the locations of tracked individuals.

The operator creates and configures the map 400 prior to using it. Prior to creating the map 400, the operator configures the map elements 402. In order to configure the map elements 402, the operator may perform the method 900 shown in FIG. 9. In FIG. 9, the operator at block 902 defines the areas 12 that tracked individuals will be able to access by presenting their credentials 40, as described below in respect of FIG. 6A. After defining the areas 12, the operator at block 904 defines which doors 22 provide entry and exit points for each of the areas 12. This may be done by associating doors 22 with the areas 12 and, for each of the doors 22, inputting whether or not the door 22 is used to enter the area 12 it is associated with, to leave the area 12 it is associated with, or both. After the areas 12 and the ways in which tracked individuals can enter and exit the areas 12 are defined, the operator proceeds to block 906 and defines area groups as described below in respect of FIG. 6B. After defining the area groups the operator saves to a non-volatile memory at block 908. In an alternative embodiment (not depicted), the operator may save to the non-volatile memory after each of blocks 902, 904, and 906.

Figure 10:
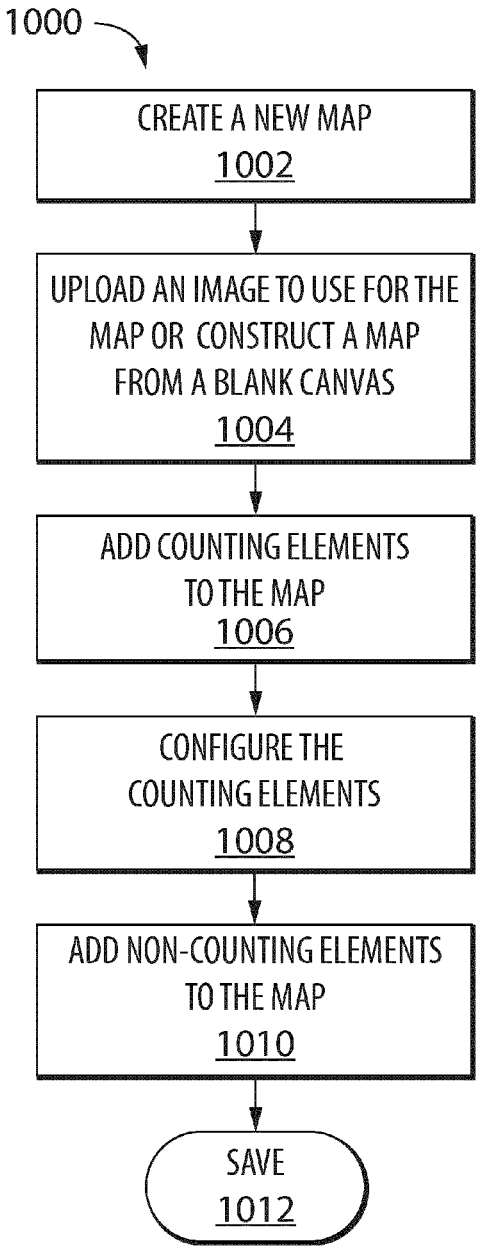

Referring now to the method 1000 of FIG. 10, the operator begins at block 1002 by creating a new map 400. In alternative embodiments (not depicted), the operator may additionally or alternatively edit an existing map 400 or change the image used as a basis for the map 400. Map creation may comprise selecting, via a graphical user interface displayed on the workstation 300, the option to create a new map. The operator then proceeds to block 1004 where the operator may instantiate the map 400 by uploading a map image or where the operator may decide to proceed with a blank canvas, in which case the operator may manually drag-and-drop map components such as cameras in order to create the map 400. The operator then proceeds to block 1006 where he or she adds counting elements to the map 400 and to block 1008 where the operator configures the counting elements. Configuring the counting elements may comprise, for example, changing the font color and size of the counting elements and determining whether the counting elements are to comprise one or both of graphics and text. After configuring the counting elements the operator proceeds to block 1010 where he or she adds non-counting elements, such as cameras and doors, to the map 400, following which the operator proceeds to block 1012 and saves the map 400 to a non-volatile memory.

Figure 6A:
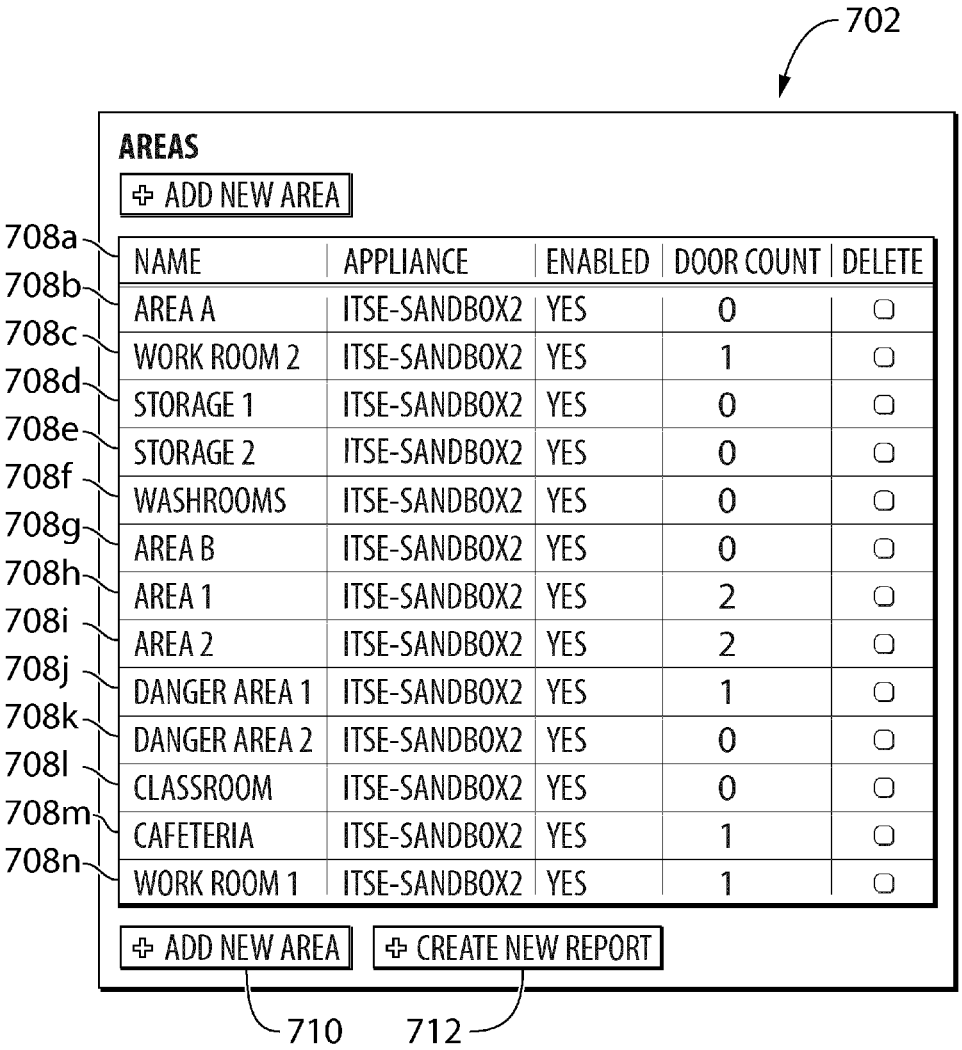
FIG. 6A is an interface that can be shown on a workstation of the system of FIG. 1 and that permits an operator of the system to define areas for which an individual must present credentials to gain access.
Figure 6B:
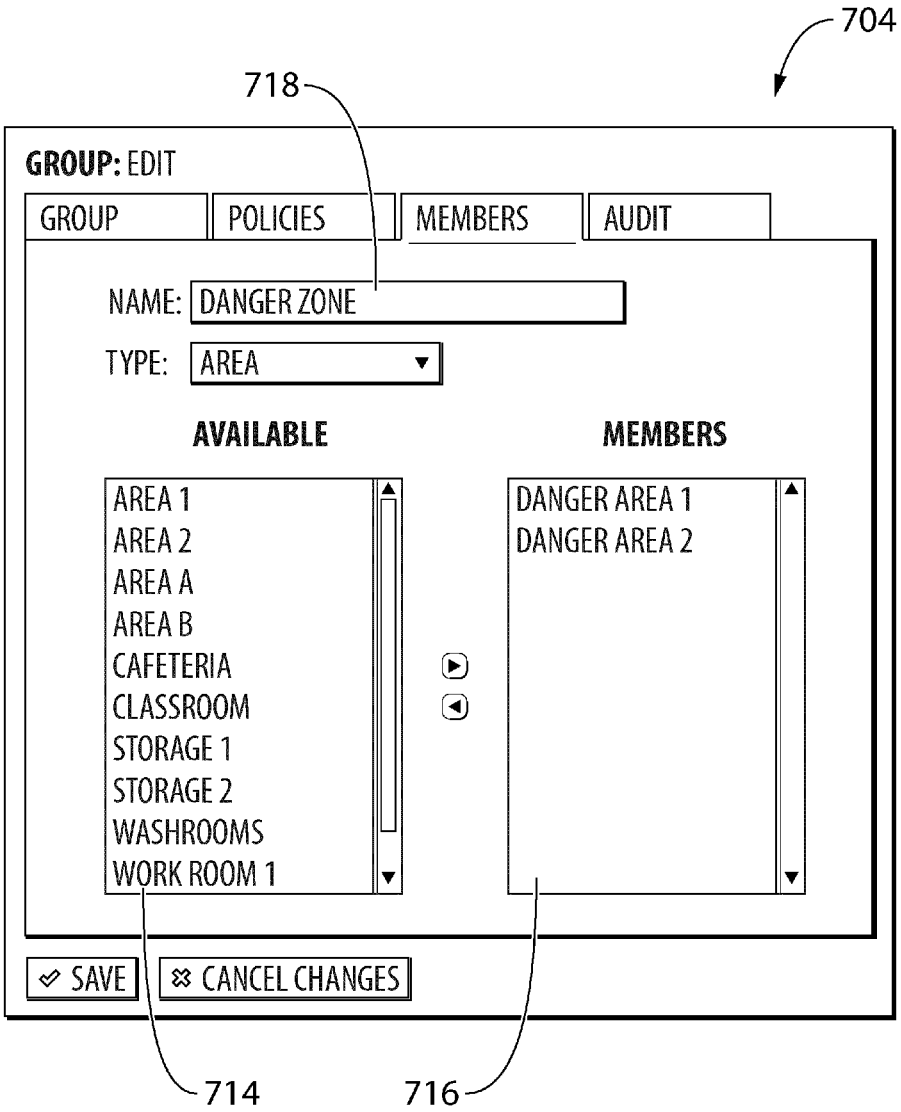
FIG. 6B is an interface that can be shown on a workstation of the system of FIG. 1 and that permits an operator of the system to define groups of the areas shown in the interface of FIG. 6A.

Referring now to FIGS. 6A and 6B, there are shown two interfaces 702,704 that permit the operator of the access control system 10 to create areas 12 and to define area groups from the areas 12. The interface 702 shown in FIG. 6A shows the operator a list of the areas 12 currently comprising part of the map 400, with each of the areas being listed in one of multiple rows 708*a-n* comprising part of the interface 702. Each of the rows 708*a-n* is divided into five columns: the leftmost column shows the area's 12 name under the heading "Name"; the second column from the left shows the particular access controller 100 used to monitor that area 12 under the heading "Appliance"; the middle column shows whether the access controller 100 for that area 12 is enabled under the heading "Enabled"; the second column from the right shows how many doors 22 control entry to and exit from that area 12 under the heading "Door Count"; and the rightmost column permits the operator to delete the areas 12. Also shown in FIG. 6A are first and second buttons 710,712 respectively permitting the operator to add new areas 12 and to generate reports, as discussed in further detail below in respect of FIG. 8. The interface 704 of FIG. 6B permits the operator to create the area groups by selecting two or more of the areas 12. Each of the areas 12 available to be selected to comprise part of an area group is listed in a first window 714, while each of the areas 12 that the operator has selected from the first window 714 to comprise part of the area group is listed in a second window 716. The name of the area group comprising the areas 12 listed in the second window 716 is shown in an editable field 718.

Figure 5:
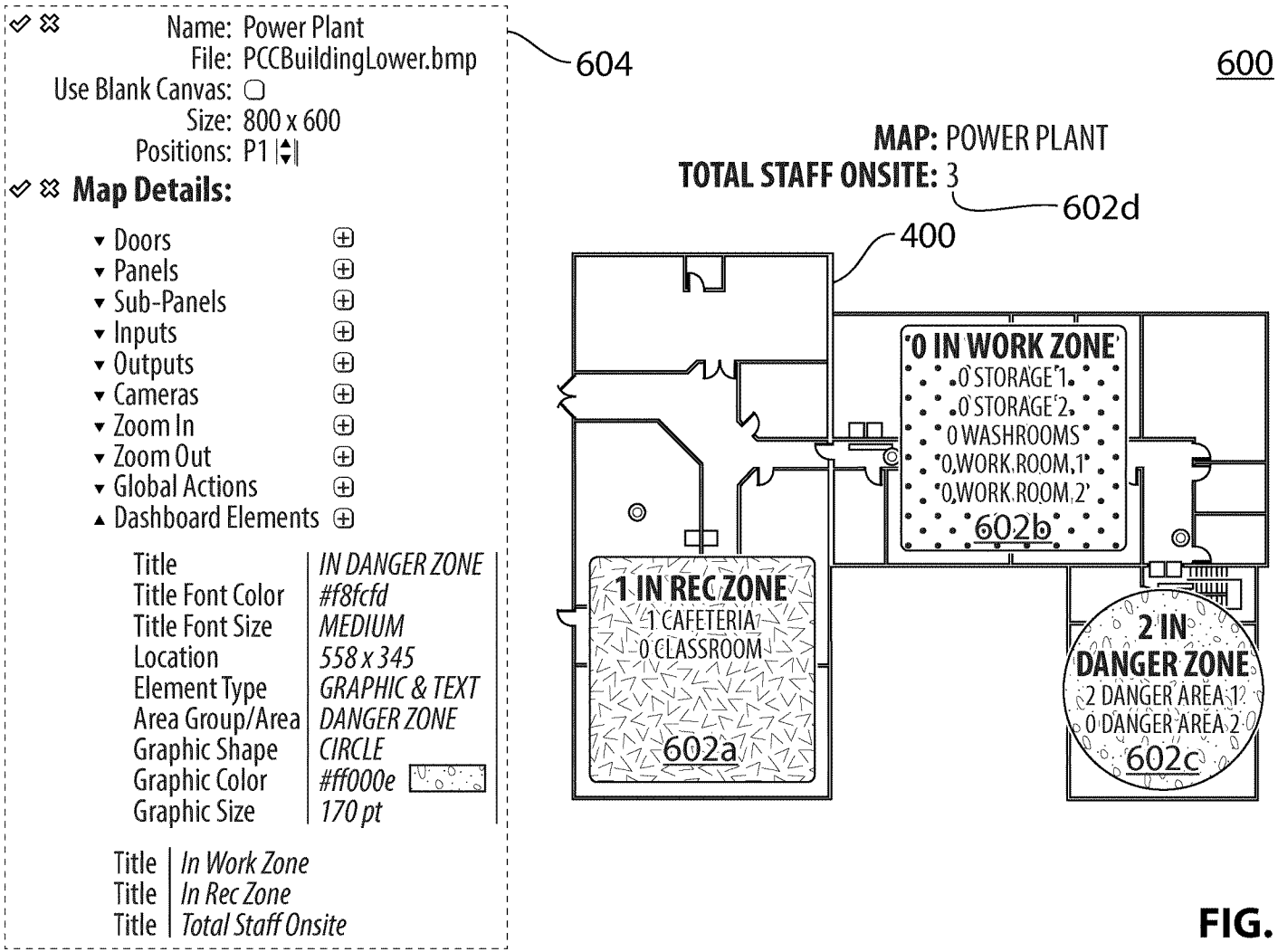
FIG. 5 is a display that can be shown on a workstation of the system of FIG. 1, showing various map elements available for placement on the map.

Each of the area groups is represented by a counting element that is shown on the map 400. Although not depicted, the operator may graphically associate the areas 12 and area groups defined in FIGS. 6A and 6B with the map 400 of FIG. 5. FIG. 5 shows four different counting elements 602 for the area groups: a recreational zone counting element 602*a*, a work zone counting element 602*b*, a danger zone counting element 602*c*, and a zone representing total staff onsite ("total staff counting element 602*d*") (collectively, "area group counting elements 602"). The counting elements 602*a-c* for the recreational, work, and danger zones are overlaid on the map 400 and, more particularly, over the areas 12 that comprise their corresponding area groups. While in the depicted embodiment these graphical representations are opaque squares and circles, in alternative embodiments (not depicted) they may instead be transparent and shaped identically to the areas 12 they comprise. The total staff counting element 602*d* is located above the map 400. Each of the area group counting elements 602 *a-c* also includes a listing of the areas 12 that comprise that area group, and the number of tracked individuals within each of those areas 12. In the depicted embodiment this listing is selectable by the operator via the browser 1200 to bring up a detailed listing of information regarding any selected tracked individuals, as discussed in more detail in respect of FIG. 8 below.

The panel 604 provides the operator with a variety of options when customizing the interface 600. For example, as shown in FIG. 5 with respect to the danger zone counting element 602*c*, the panel 604 allows the operator to change the title of area group counting elements 602; to change the font color, size, and location used to identify the area group counting elements 602; to decide whether the area group counting element 602 is to comprise one or both of graphic and text; and, if the area group counting element 602 comprises a graphic, to change that graphic's shape, color and size.

Figure 15:
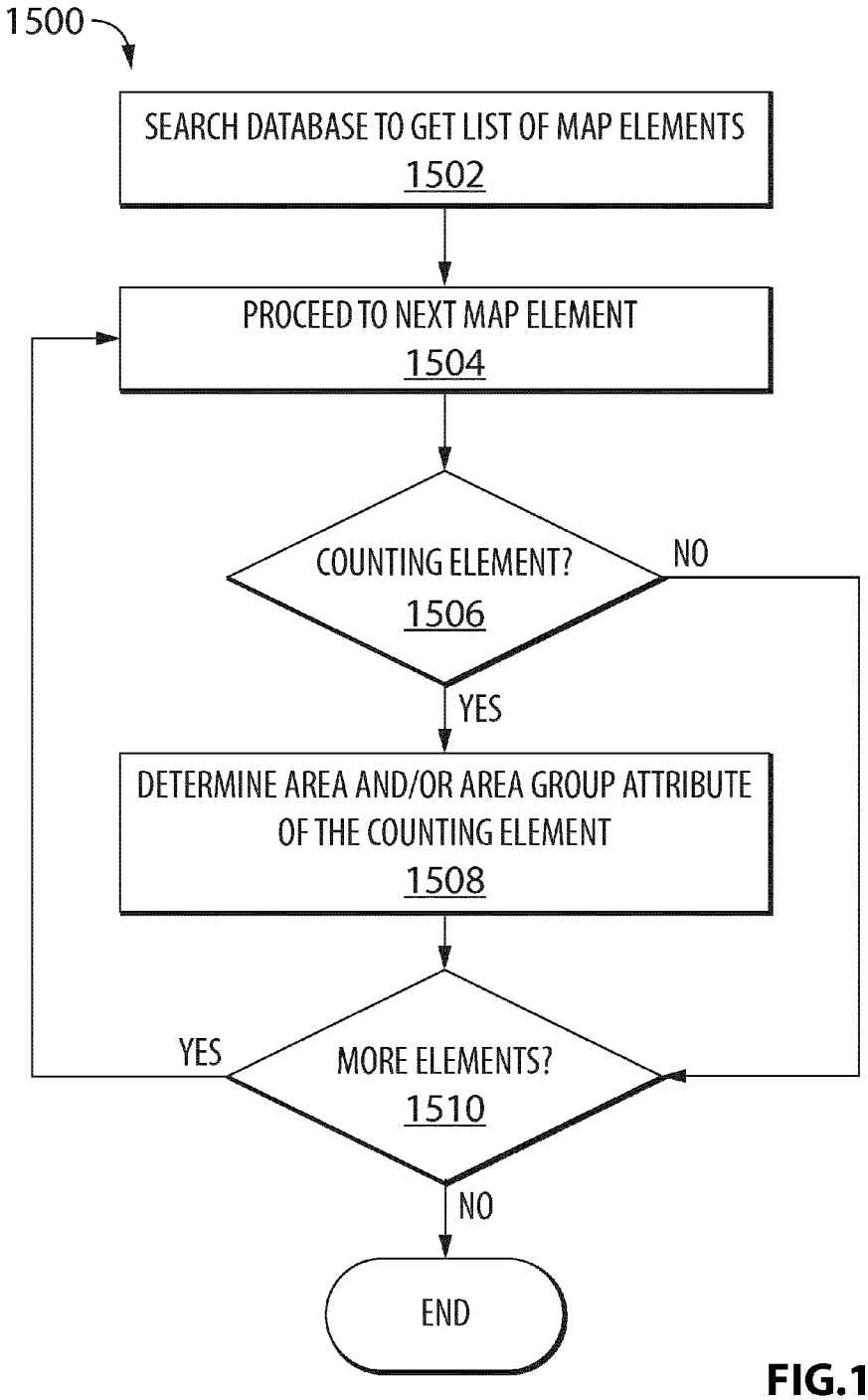
FIG. 15 is a flowchart depicting an example method for determining which elements of a map are elements that are dynamically updated to show a current number of tracked individuals.

Referring now to FIG. 15, there is shown a method 1500 for generating and populating the map 400 and map elements 402 on the workstation 300. At block 1502 the realtime server 1204 retrieves from the database 1210 all of the map elements 402 (both counting and non-counting elements) associated with the map 400. In the depicted embodiment in which the database 1210 is an LDAP database, the map 400 has one or more distinguished names (each a "dn") that is also associated with all of the map elements 402 for that map 400. Each of the map elements 402 has a do from which the realtime server 1204 can load attributes about the element 402 that enable the realtime server 1204 to determine whether the element 402 is a counting or non-counting element, which the realtime server 1204 does at block 1506. If the element 402 the realtime server 1204 is analyzing is a counting element, the realtime server 1204 proceeds to block 1508 where it determines the area 12 and/or area group attribute of the counting element, following which the realtime server 1204 proceeds to block 1510 to determine whether there are any more map elements 402 to analyze. If no, the method 1500 ends. If yes, the realtime server 1204 returns to block 1504 to analyze the next element 402. The realtime server 1204 also proceeds to block 1510 directly from block 1506 if the element being analyzed at block 1506 is a non-counting element.

Figure 13:
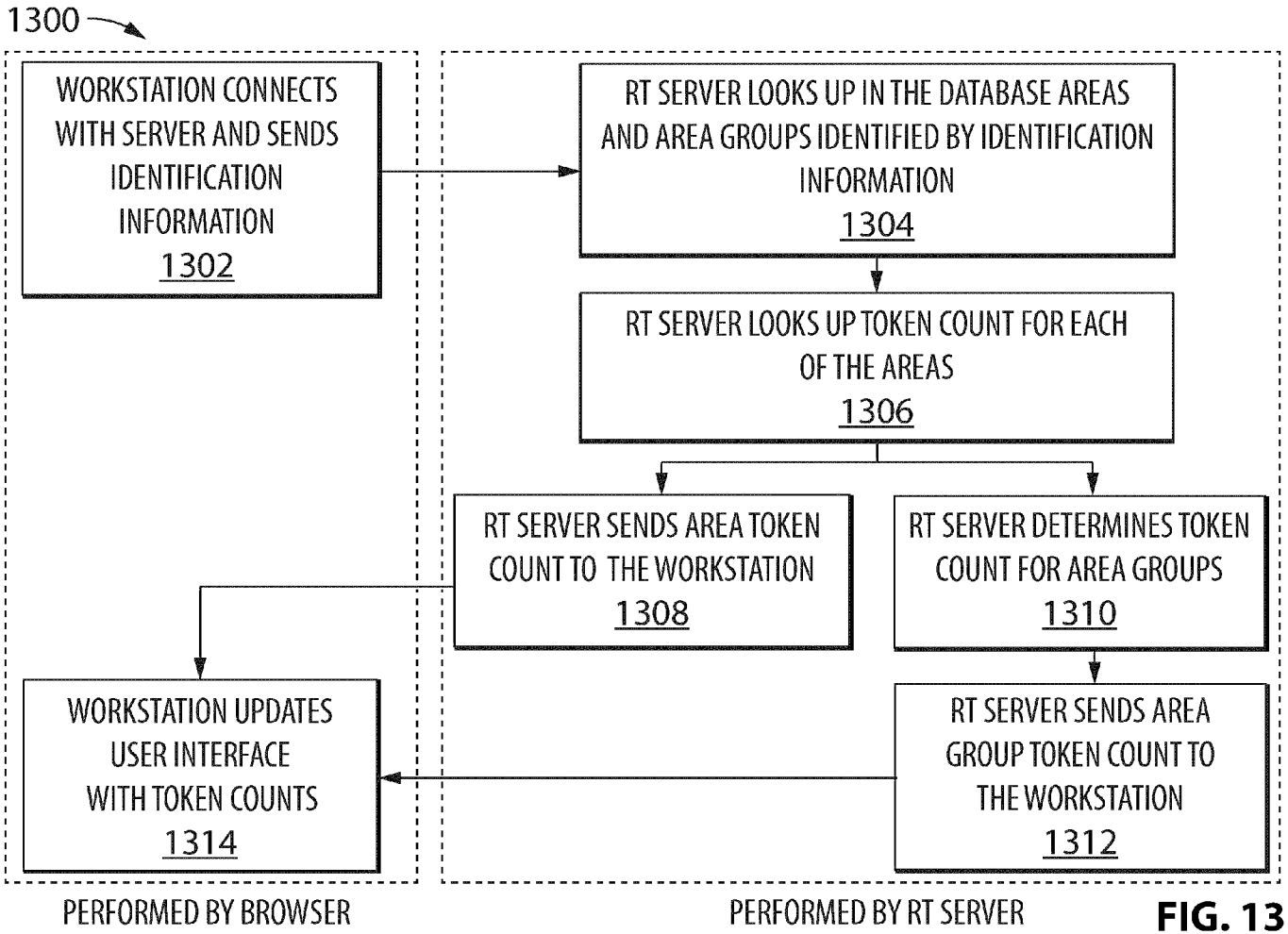
FIGS. 13 and 14 are flowcharts depicting example methods for updating a map used to display the locations of tracked individuals.

Referring now to FIG. 13, there is shown a method 1300 for displaying the map elements 402 with token counts in response to a request the operator has made via the workstation 300; i.e., for updating the counting elements so that the workstation 300 is able to display via the browser 1200 how many tracked individuals are present in each of the areas 12 and area groups.

The method begins at block 1302 where the browser 1200 makes a connection to the realtime server 1204 via the web server 1203 in response to the operator viewing the map 400, as alluded to above in respect of FIG. 12. The browser 1302 transmits along this connection identification information regarding the map 400 the operator viewed. In the depicted embodiment in which the database 1210 is an LDAP database, this identification information comprises the do of the map 400. At block 1304 of the method 1300, the realtime server 1204 looks up in the database 1210 a list of areas 12 and area groups that are identified by that identification information; i.e., a list of areas 12 and area groups having counting elements displayed on the map 400. In the method of FIG. 13, it is presumed that all of the areas 12 and area groups have corresponding counting elements displayed on the map 400. An example method for implementing block 1304 is shown in FIG. 15. At block 1306, the realtime server 1204 looks up the token count for each of the areas 12 identified by the identification information (e.g., using the middleware 1208) and sends the number of tokens for each of the areas 12 to the browser 1200 (block 1308) via the web server 1203, following which the browser 1200 updates each of the counting elements for those areas 12 on the map 400 with the number of tokens for that area 12 (block 1314); this corresponds to the number of tracked individuals present in those areas 12 if those individuals have properly used the access control system 10. From block 1306 the realtime server 1204 also proceeds to block 1310 where it determines how many tokens are present in each of the area groups by adding all the tokens in all the areas 12 that comprise each of the area groups. From block 1310 the realtime server 1204 proceeds to block 1312 where it sends the area group token count to the browser 1200 via the web server 1203. The browser 1200 then updates each of the area groups counting elements 602 on the map 400 with the number of tokens for that area group (block 1314) as it receives this information from the realtime server 1204 via the web server 1203; this corresponds to the number of tracked individuals present in those area groups 602 if those individuals have properly used the access control system 10.

Figure 14:
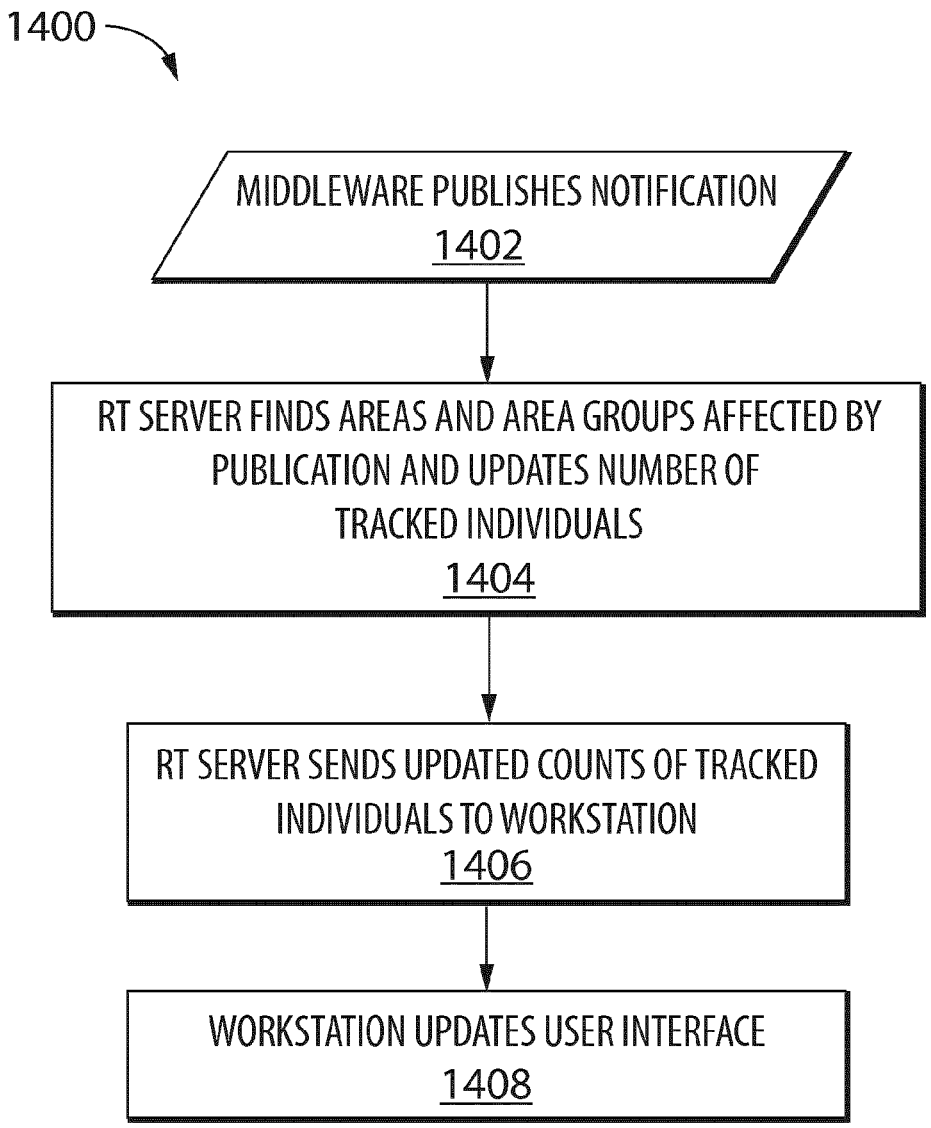

As mentioned above, when the door controller 26 permits someone access to one of the areas 12 in response to being presented with credentials 40, the database 1210 is updated with the new token count for the area 12 in question, and the middleware 1208 is subsequently updated with this new token count. Once updated, the middleware 1208 publishes a notification to the realtime server 1204 that the token count in one of the areas 12 has changed; in the event the token counts in more than one of the areas 12 have changed, the middleware 1208 publishes multiple notifications. FIG. 14 shows a method 1400 the access control system 10 performs in response to this type of notification. At block 1402 the middleware 1208 publishes the notification to the realtime server 1204 that the token count in one of the areas 12 has changed. At block 1404 the realtime server 1204 updates its own count of the tokens associated with the area 12 and any area groups 602 affected by the change in token count. The realtime server 1204 then sends these updated counts to the browser 1200 via the web server 1203 (block 1406), which displays then on the workstation 300 (block 1408), assuming that counting elements for those areas 12 and area groups 602 are shown on the map 400.

Figure 11:
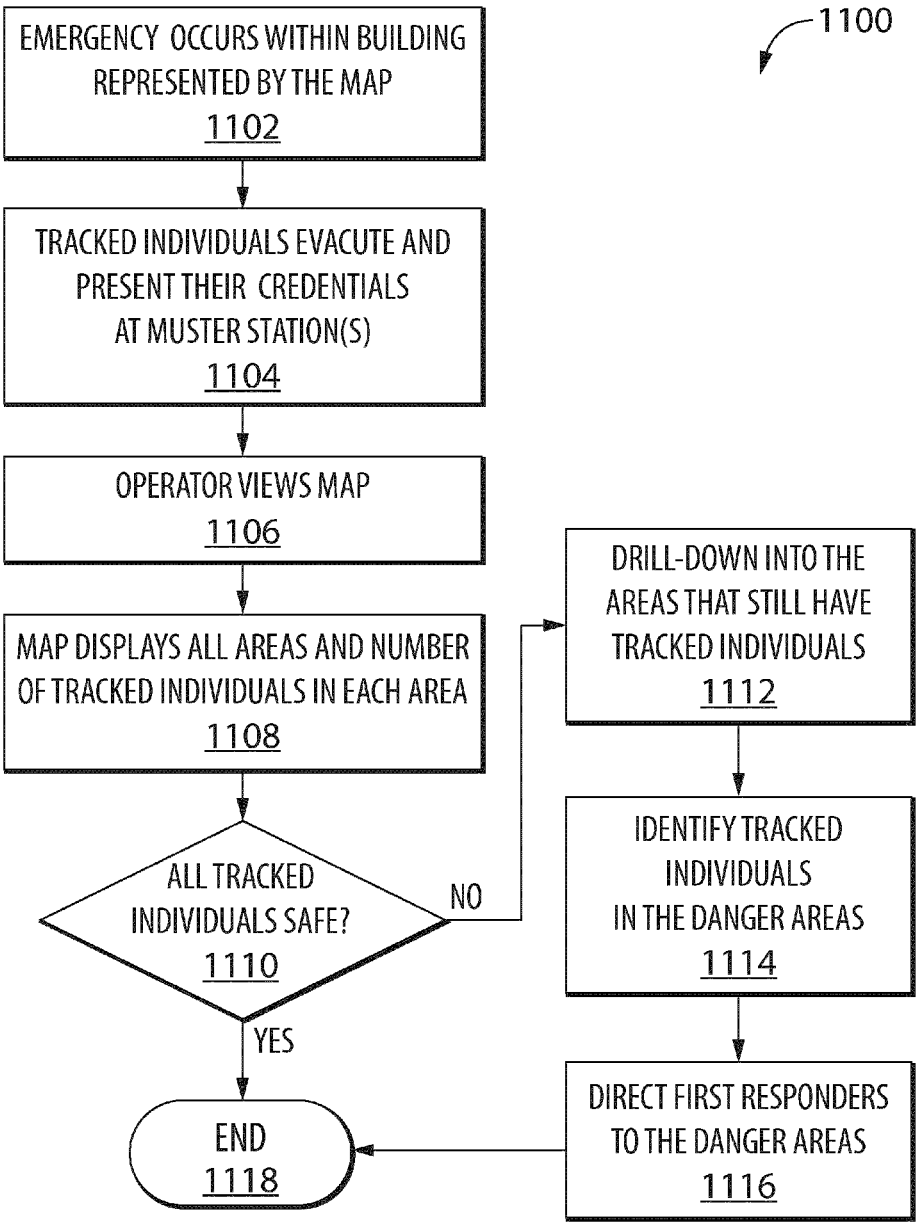
FIG. 11 shows a flowchart depicting an example method for addressing an emergency scenario.

Referring now to FIG. 11, there is shown a method 1100 for addressing a muster scenario using the access control system 10. In FIG. 11, the muster scenario is that an emergency has occurred within a building represented by the map 400 (block 1102). Each of the tracked individuals present their credentials 40 at a muster station in one of the areas 12 (block 1104). Alternatively, the controller 100 may determine who is present in any of the areas 12 simply from a record of who has presented credentials 40 to gain access to those areas 12 but has not yet presented credentials 40 to leave those areas 12. At block 1106 the operator views the map 400 and instructs the controller 100 via the workstation 300 to display the map 400 on the workstation 300. At block 1108 the controller 100 displays the map 400 with the area groups counting elements 602 overlaid thereon, thus informing the operator of the number of tracked individuals in each of the areas 12, as shown in FIG. 5.

Figure 7:
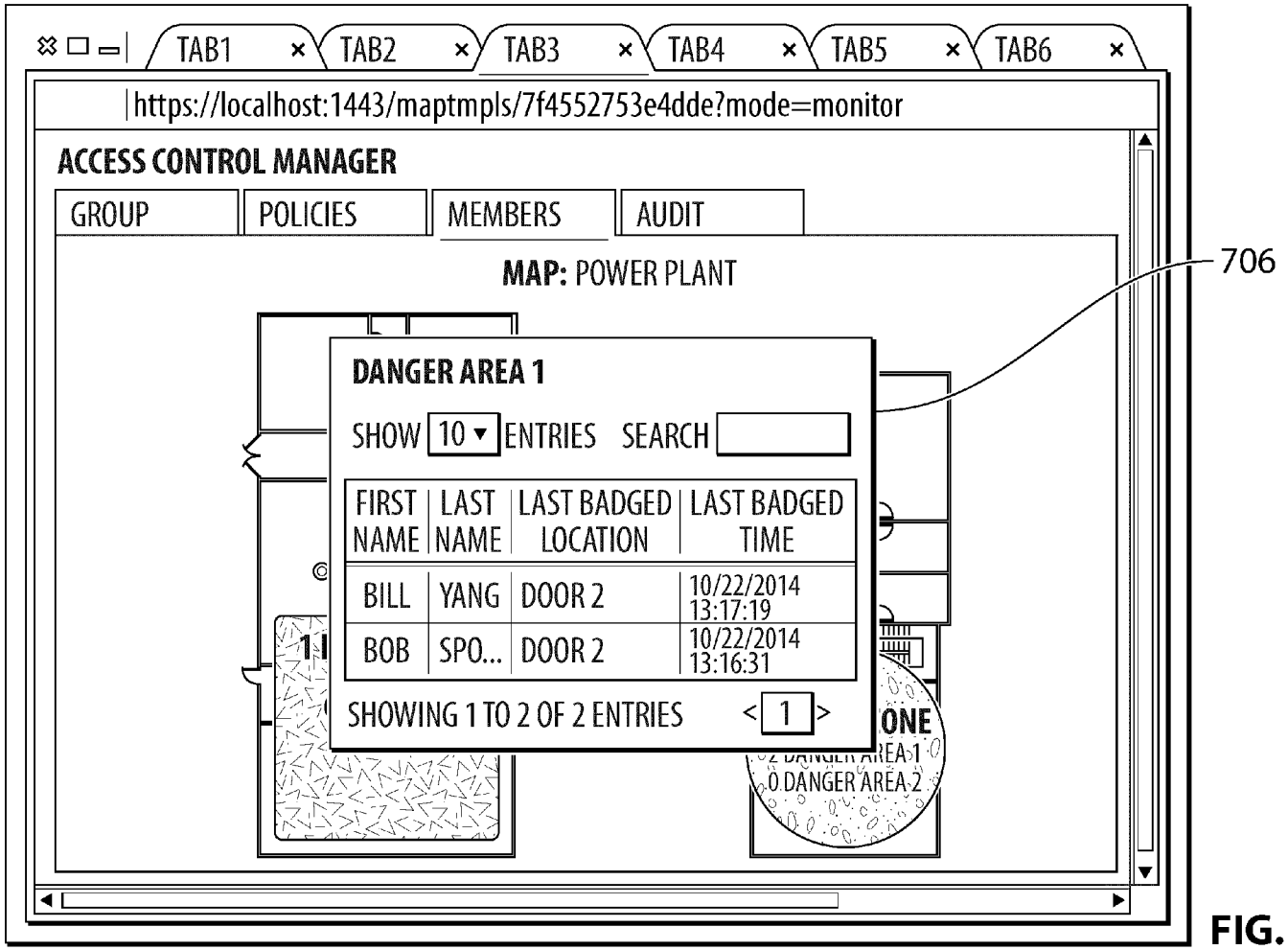
FIG. 7 is an example detailed listing, based on the map of FIG. 2, showing data specific to individuals within one of the area groups of FIG. 2.

At block 1110, the operator determines whether all of the tracked individuals are in safe areas. If so, the operator may proceed to block 1118 where the method 1100 ends. However, in the map 400 of FIG. 5 this is not the case, as evidenced by the two tracked individuals being present in the danger zone area group. The operator accordingly proceeds to block 1112 and clicks on the text "2 Danger Area 1" in the danger zone counting element 602*c* in order to view a list 706 of the tracked individuals in danger area 1, which is one of the areas 12 that comprises the danger zone area group. The list 706 is shown in FIG. 7, and this process is referred to as "drilling down". This list 706 shows the operator the full name of each of the tracked individuals in the danger zone area group, the door 22 via which each entered the area 12 in which they are located, and the time each presented his or her credentials 40 in order to gain access to that area 12. The operator can then relay this information to first responders and direct them to the danger zone area group (block 1116). After doing this the method 1100 ends at block 1118. The ability to "drill down" can be restricted to operators of the access control system 10 who have at least a minimum security clearance level.

Figure 16:
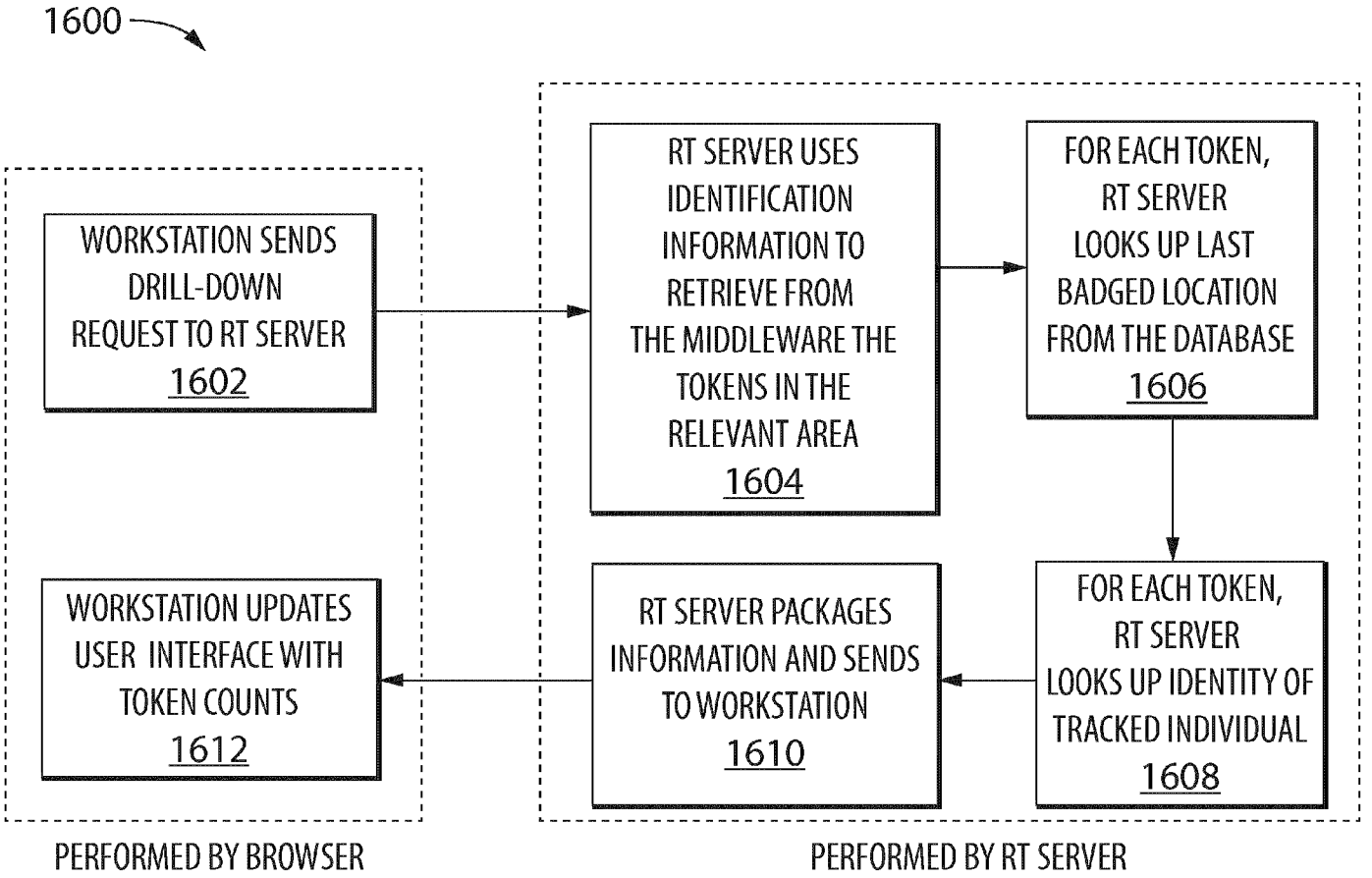
FIG. 16 is a flowchart depicting an example method for obtaining and displaying the individual-specific data shown in FIG. 7.

FIG. 16 shows a method 1600 that may be performed when drilling down. At block 1602, the operator sends a request via the browser 1200 to the realtime server 1204 to drill down into one of the areas 12. The realtime server 1204 at block 1604 uses identification information for the area 12 for which the request is made to retrieve from the middleware 1208 the tokens in that area 12. In the depicted embodiment in which the database 1210 is an LDAP database, the realtime server 1204 obtains the distinguished names of each of the tokens in the area 12. At block 1606, the realtime server 1204 looks up the last badged location (i.e., the location of the last credentials reader 28 that read the credentials 40) for the token from the database 1210 and at block 1608 retrieves the identity information of the tracked individual associated with the token. At block 1610 the realtime server 1204 packages (e.g., in the JavaScript Object Notation format) and transmits the identity (e.g., first and last names) and last badged location information to the workstation 300 via the web server 1203, and the workstation 300 at block 1612 displays this information via the browser 1200 as shown in FIG. 7. While in the depicted embodiment the operator is permitted to drill down into any one of the areas 12, in an alternative embodiment (not depicted) the operator may be permitted to drill down into one of the area groups; in this embodiment, drilling down into one of the area groups may bring up a detailed listing comprising all of the tracked individuals located within that area group. While in this example embodiment, the realtime server 1204 sends at least the first and last name to the workstation 300, in alternative embodiments (not depicted) the realtime server 1204 may send additional information such as the name of the area 12 in which the tracked individual is located, the name of the last door 22 entered by the tracked individual, the distinguished name used to identify the tracked individual, and the last time the tracked individual had his or her credentials 40 read by one of the credentials readers 28.

Referring now to FIG. 8, there is shown an area identity report 800 that the operator may instruct the controller 100 to generate via the workstation 300. The report 800 lists each of the tracked individuals presently being tracked by the access control system 10; the area 12 in which each of the tracked individuals is located; the last door 22 that each of the tracked individuals accessed and when that door 22 was accessed; the category assigned to each of the tracked individuals (e.g. visitor, employee, or contractor), and the reference/token number assigned to the credentials 40 used by the tracked individuals. The report 800 may be filtered by area 12 or area group and may be periodically and automatically generated by the controller 100. The access control system 10 may output the report 800 in a variety of formats, such as in the Portable Document Format and CSV formats, at the request of the operator.

Figure 3:
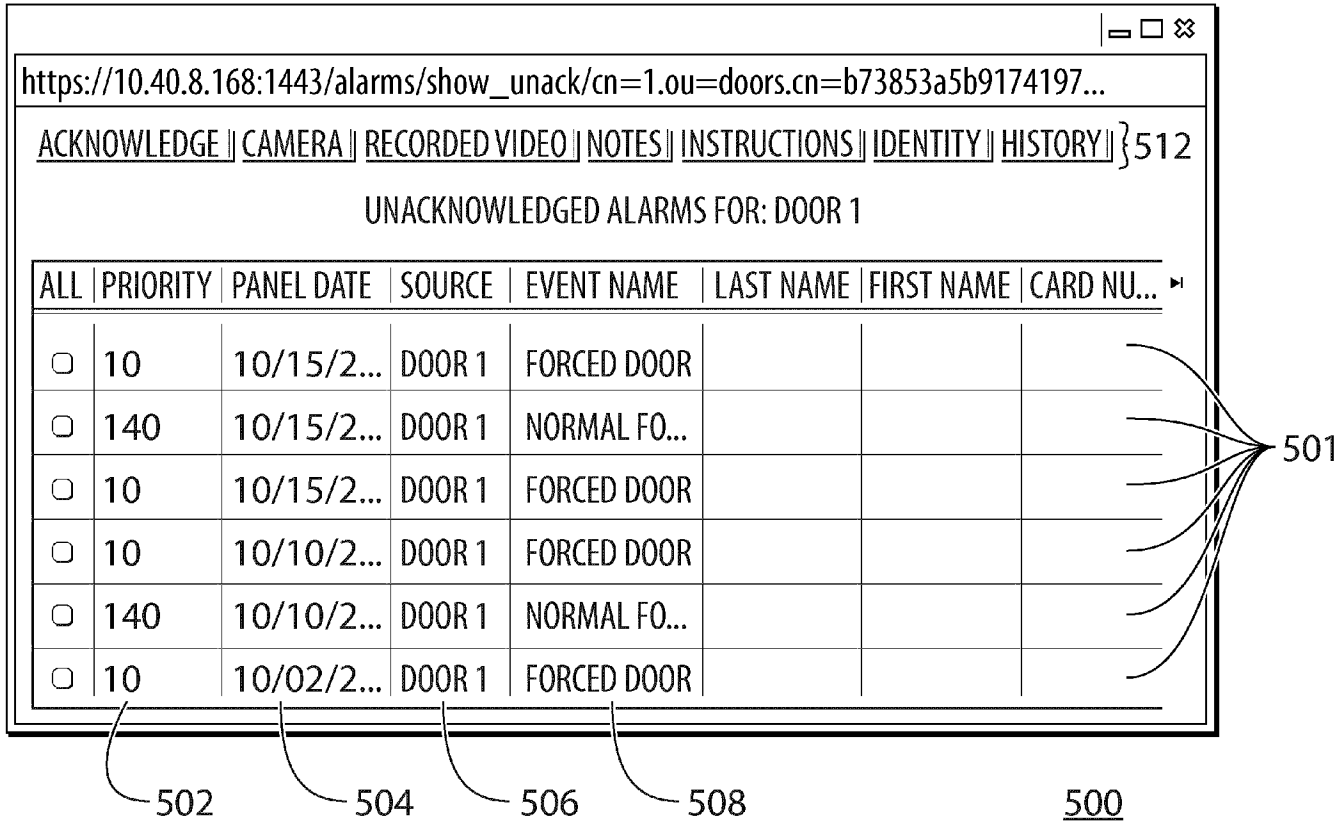
FIG. 3 is a report showing a list of alarms associated with a specific door represented on the map of FIG. 2.

The controller 100 may alert the operator to the occurrence of one or more of the security related events by displaying an alarm panel 500, such as that shown in FIG. 3, on the workstation 300. The alarm panel 500 comprises a table having multiple rows 501, each of which indicates a different alarm. Each alarm has a priority 502; a date and time 504 at which the alarm occurred; a source 506, which is the hardware and/or software that triggered the alarm; and an event name 508 describing the alarm.

Figure 4:
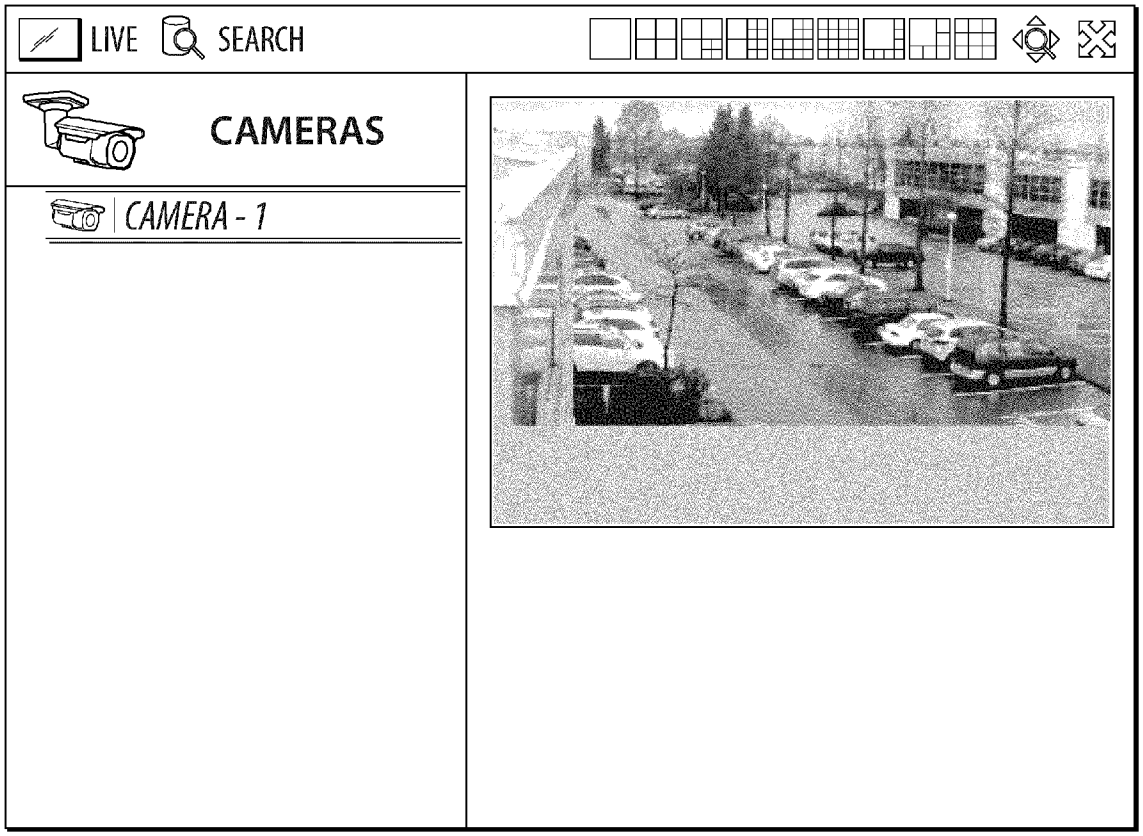
FIG. 4 is video associated with one of the alarms reported in FIG. 3.

The alarm panel 500 also comprises a row of buttons 512: an "acknowledge" button that permits the operator to acknowledge the alarm, which dismisses it; a "camera" button and a "recorded video" button to view live and recorded video, respectively, from a camera recording a region where the event triggering the alarm occurred (e.g., if the alarm is that an invalid credential has been presented, the video may be of the individual presenting the credential; an example video is shown in FIG. 4); a "notes" button that permits the operator to enter notes relating to the alarm (e.g., if one of the doors has been tampered with and the operator has sent someone to investigate, the operator may enter notes detailing the investigation's results); an "instructions" button that displays pre-defined instructions telling the operator how to react to the alarm (e.g., if a door has been broken into, the instructions may be of how to lock down the building and call the police); an "identity" button used to identify the tracked individual associated with the alarm (e.g. if the event is an anti-passback violation as discussed below, the credentials 40 of the individual who has committed the violation can be displayed); and a "history" button used to permit the operator to view past alarms associated with the map element.

Anti-passback

In one embodiment, the system attempts to prevent the tracked individuals from "passing back" their credentials 40; that is, from using their credentials 40 to let a third party into one of the areas 12 without first exiting that area 12. To implement functionality that prevents passing back from occurring ("anti-passback functionality" or "APB functionality"), the access control system 10 may use credential readers 28 inside and outside of the areas 12 and require that credentials 40 be presented to those readers 28 in order to enter and exit the areas 12. For example, if a tracked individual presents his or her credentials 40 to one of the readers 28 to enter one of the areas 12, then presents his or her credentials 40 again to leave one of the areas 12, and then tries to re-enter that area 12 by presenting his or her credentials 40 again, the controller 100 would not conclude an anti-passback violation has occurred. However, if a tracked individual presents his or her credentials 40 to one of the readers 28 to gain access to one of the areas 12 and then passes his or her credentials 40 back to a third party who tries to enter the area 12 with those credentials 40 without the tracked individual first having left the area 12, the controller 100 would determine that an anti-passback violation has occurred. In another embodiment (not depicted), the anti-passback violation may only be triggered if a tracked individual presents his or her credentials 40 to gain access to one of the areas 12 and if the door 22 to that area 12 is opened and closed after unlocking in response to the presentation of the credentials 40; this addresses the scenario in which the individual may be granted access to, but not actually enter, the area 12.

Various rules, which can be stored in the credential and policy directory 200, can be used to determine whether or not an anti-passback violation has occurred:

1. Door-Based Timed anti-passback rule ("APB rule"): The controller 100 keeps track of each set of credentials 40 used to enter an area 12 through the doors 22 and does not allow the same credentials 40 to be used to enter an area 12 two successive times unless an anti-passback time limit is reached.
2. Token-Based Timed APB rule: The controller 100 tracks each door 22 a set of credentials 40 has accessed. Once the credentials 40 have been used to access one door 22, they then must be used to access a different door 22 or the anti-passback time limit must be reached before the credentials 40 may be used to access the first door again.
3. Hard Door APB rule: The controller 100 tracks each set of credentials 40 that is used to access a door 22 and does not allow the same credentials to access it twice in a row until the credentials 40 are used to access a different door 22.
4. Soft Door APB rule: This is the same as Hard Door APB rule except that the tracked individual is still able to access the same door 22 a second time without first accessing a different door 22 but the access is logged as an anti-passback violation.
5. Hard Area APB rule: This mode tracks each set of credentials 40 that is used to access any of the areas 12 and defines which of the areas 12 the credentials 40 may access next. The tracked individual is denied access if they attempt to enter the area 12 without first exiting it.
6. Soft Area APB rule: This is the same as Hard Area APB rule except that the tracked individual is still able to re-enter without first exiting the area 12, but the access is logged as an anti-passback violation.

De-mustering

The access control system 10 also permits the operator to de-muster the areas 12. In one embodiment, de-mustering allows the operator to temporarily suspend the APB rules to permit one or more of the tracked individuals to enter an area 12 notwithstanding that doing so would trigger an anti-passback violation but for the suspension of the APB rules. The operator may de-muster in this manner by selecting any one or more tracked individuals, in which case the APB rules are suspended for those one or more tracked individuals; any one or more counting elements for the areas 12, in which case the APB rules are suspended for any tracked individuals in those one or more areas 12; and any one or more counting elements for the area groups, in which case the APB rules are suspended for any tracked individuals in those one or more area groups. For example, if the APB rules are preventing a tracked individual from re-entering an area 12 he or she had previously been in, suspending the APB rules permits that individual to re-enter that area 12 regardless of whether doing so would result in an anti-passback violation but for the suspension of the APB rules. De-mustering may be used after an emergency situation has ended, for example, and the operator wishes to permit all tracked individuals to return to the areas 12 from which they came without having to consider whether doing so will result in any anti-passback violations. In an alternative embodiment, de-mustering may comprise resetting, as opposed to only temporarily suspending, the APB rules. When de-mustering is done in this manner, any counting elements on the map 400 showing the location of the tracked individuals being de-mustered are updated once those individuals present their credentials 40 to enter a new area 12.

In some embodiments, the controller 100 records in the database a "last area" attribute representing the last area 12 in which the tracked individual is recorded as being present. In these embodiments, de-mustering may additionally or alternatively comprise the operator manually updating the last area attribute for any one or more tracked individuals. As described in the immediately preceding paragraph, the operator may select which of the tracked individuals to de-muster on a per individual basis, on a per area 12 basis, or on a per area group basis. More than one of the tracked individuals may be simultaneously de-mustered, in which case the operator may select a new last area for all of the individuals being de-mustered, and the controller 100 may then simultaneously update the last area attribute for all of these de-mustered individuals. Once the last area attribute is updated, the controller 100 updates the counting elements on the map 400 to reflect the new last area for the de-mustered individuals.

Alternatively or additionally, de-mustering one of the tracked individuals comprises deleting from the database 1204 the last area for that individual, updating the map 400 by decrementing the counting element associated with that individual by one, waiting for the individual to again present his or her credentials 40 to one of the credential readers 28, and then updating the last area attribute and the map 400 once the controller 100 obtains a new area 12 for that individual by virtue of having read the credentials 40. As above, de-mustering in this manner may be done on a per tracked individual, per area 12, or per area group basis.

While in the above embodiments the controller 100 performs mustering by monitoring who has entered the areas 12 via the door systems 20, in alternative embodiments (not depicted) mustering may additionally or alternatively be performed in one or more other ways. For example, the controller 100 may be configured to require individuals to present their credentials 40 to a muster station (not shown) within the areas 12 that does not grant the individuals access into or out of any of the areas 12 but that the controller 100 nonetheless uses to determine who is present in which of the areas 12. The muster station may or may not be a standalone device and comprises the credential reader 28 to permit it to read the individuals' credentials 40. Using a mustering station that is decoupled from the door systems 20 permits the controller 100 to accurately track individuals notwithstanding a passback violation that may have granted those individuals access to the areas 12 without first scanning those individuals' credentials 40.

It is contemplated that any part of any aspect or embodiment discussed in this specification can be implemented or combined with any part of any other aspect or embodiment discussed in this specification.

FIGS. 9-11 and 13-16 are flowcharts of example embodiment methods. Some of the blocks illustrated in the flowcharts may be performed in an order other than that which is described. Also, it should be appreciated that not all of the blocks described in the flowcharts are required to be performed, that additional blocks may be added, and that some of the illustrated blocks may be substituted with other blocks. For example, in FIG. 10 the cameras, doors, and various other non-counting elements need not be added at block 1010 after block 1006; the various map elements 402 (whether counting or non-counting elements) may be added in any order the operator desires. The example methods may be stored on to non-volatile memory as program code for execution by the controller 100. Examples of non-volatile memory are non-transitory and include disc-based media such as CD-ROMs and DVDs, magnetic media such as hard drives and other forms of magnetic disk storage, and semiconductor based media such as flash media, random access memory, and read only memory. The controller 100 may comprise any suitable type of processor, microprocessor, microcontroller, programmable logic controller, or application-specific integrated circuit, for example, to execute the program code.

For the sake of convenience, the example embodiments above are described as various interconnected functional blocks. This is not necessary, however, and there may be cases where these functional blocks are equivalently aggregated into a single logic device, program or operation with unclear boundaries. In any event, the functional blocks can be implemented by themselves, or in combination with other pieces of hardware or software.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A method for tracking at least first and second individuals, the method comprising:

retrieving a first location of the first individual, wherein the first location is associated with a first credentials acquisition device that has acquired credentials of the first individual;

retrieving a second location of the second individual, wherein the second location is associated with a second credentials acquisition device that has acquired credentials of the second individual;

providing a map on a display that includes at least first and second different areas within which are situated the first and second locations respectively; and providing first and second counting elements on the display, the first and second counting elements indicating numbers of tracked individuals in the first and second areas respectively.

2. The method of claim 1 wherein the first counting element overlaps at least part of the first area and the second counting element overlaps at least part of the second area.

3. The method of claim 1 wherein at least one of the first and second credentials acquisition devices comprises a muster station.

4. The method of claim 1 wherein the first and second locations comprise physically enclosed spaces.

5. The method of claim 1 wherein the first and second locations comprise non-physically enclosed spaces.

6. The method of claim 1 wherein the map comprises a three dimensional rendering of a building.

7. The method of claim 1 further comprising providing a non-counting element on the map, the non-counting element providing information other than how many of the tracked individuals are present in the first and second areas.

8. The method of claim 1 wherein providing the map on the display comprises displaying an indication that the tracked individuals are present at the first and second locations on the map.

9. The method of claim 8 wherein the map comprises additional areas of which each is associated with a different credentials acquisition device, wherein the tracked individuals are additionally present in additional locations corresponding to the additional areas, and wherein the indication comprises additional counting elements displaying a total number of the tracked individuals in the additional areas corresponding to the additional locations in which the tracked individuals are present.

10. The method of claim 8 further comprising:

receiving a request from a client for more particular information about the first individual;

retrieving the more particular information; and displaying, on the display, a listing comprising the more particular information.

11. The method of claim 10 wherein the request comprises a selection of the indication via a user interface.

12. The method of claim 10 wherein the more particular information comprises a name of the first individual.

13. The method of claim 10 wherein the more particular information comprises a last badged location of the first individual, wherein the last badged location of the first individual comprises a location associated with a credentials acquisition device that last acquired the credentials of the first individual.

14. The method of claim 13 wherein the more particular information comprises a last badged time of the first individual, wherein the last badged time comprises the time at which the last badged location was acquired.

15. The method of claim 1 further comprising providing a third counting element on the display indicating a total number of the tracked individuals in an area group comprising the first and second areas.

16. The method of claim 15 wherein the third counting element overlaps at least part of the area group.

17. The method of claim 16 wherein the third counting element overlaps all of the areas comprising the area group.

18. The method of claim 15 further comprising:

acquiring the credentials of a third individual who is one of the tracked individuals ("acquired credentials") using a third credentials acquisition device associated with a third location; and determining whether the third individual has committed an anti-passback violation in association with the third location.

19. The method of claim 18 wherein determining whether the third individual has committed an anti-passback violation comprises:

determining whether the acquired credentials have been used to access the third location two successive times that are separated by less than an anti-passback time limit; and when the acquired credentials have been used to access the third location two successive times that are separated by less than the anti-passback time limit, determining that the anti-passback violation has been committed.

20. The method of claim 18 wherein determining whether the third individual has committed an anti-passback violation comprises:

determining whether the acquired credentials have been used to access the third location two successive times; and when the acquired credentials have been used to access the third location two successive times, determining that the anti-passback violation has been committed.

21. The method of claim 18 wherein determining whether the third individual has committed an anti-passback violation comprises:

determining whether the acquired credentials have been used to access and to subsequently exit the third location, and whether the acquired credentials have not been used to re-enter the third location since being used to exit the third location; and when the acquired credentials have not been used to access and to subsequently exit the third location, and when the acquired credentials have not been used to re-enter the third location since being used to exit the third location, determining that the anti-passback violation has been committed.

22. The method of claim 18 wherein the third location is accessible via an access point from the first location, and wherein the method further comprises when the anti-passback violation has been determined to have been committed, preventing the third individual from entering the third location from the first location via the access point.

23. The method of claim 22 further comprising:

receiving a request from a client to de-muster the third individual; and de-mustering the third individual by:

receiving from the third credentials acquisition device a request by the third individual to enter the third location from the first location; and permitting the third individual to enter the third location from the first location via the access point notwithstanding the anti-passback violation.

24. The method of claim 23 wherein the de-mustering further comprises decrementing the first counting element by one.

25. A system for tracking at least first and second individuals, the system comprising:

an access controller;

first and second credentials acquisition devices communicatively coupled to the access controller and that have acquired credentials of the first and second individuals, respectively;

a non-volatile memory communicatively coupled to the access controller and having stored thereon the credentials of the first and second individuals and first and second locations respectively associated with the first and second credentials acquisition devices;

wherein the access controller is configured to perform a method comprising:

retrieving the first and second locations;

providing a map on a display that is communicatively coupled to the access controller and that includes at least first and second different areas within which are situated the first and second locations respectively; and providing first and second counting elements on the display, the first and second counting elements indicating numbers of tracked individuals in the first and second areas respectively.

26. The system of claim 25 wherein at least one of the first and second credentials acquisition devices comprises a muster station.

27. The system of claim 25 wherein the first and second locations comprise physically enclosed spaces.

28. The system of claim 25 wherein the first and second locations comprise non-physically enclosed spaces.

29. The system of claim 25 wherein the map comprises a three dimensional rendering of a building.

30. The system of claim 25 wherein the method further comprises providing a non-counting element on the map, the non-counting element providing information other than how many of the tracked individuals are present in the first and second areas.

31. The system of claim 25 wherein providing the map on the display comprises displaying an indication that the tracked individual are present at the first and second locations on the map shown on the display.

32. The system of claim 31 wherein the map comprises additional areas of which each is associated with a different credentials acquisition device, wherein the tracked individuals are additionally present in additional locations corresponding to the additional areas, and wherein the indication comprises additional counting elements displaying a total number of the tracked individuals in the additional areas corresponding to the additional locations in which the tracked individuals are present.

33. The system of claim 25 wherein the first counting element overlaps at least part of the first area and the second counting element overlaps at least part of the second area.

34. The system of claim 33 wherein the access controller is communicative with a client, and in response to a request from the client for more particular information stored on the non-volatile memory about the first individual:

retrieves the more particular information from the non-volatile memory; and displays, on the display, a listing comprising the more particular information.

35. The system of claim 34 wherein the request comprises a selection of the indication via a user interface.

36. The system of claim 34 wherein the more particular information comprises a name of the first individual.

37. The system of claim 34 wherein the more particular information comprises a last badged location of the first individual, wherein the last badged location of the individual comprises a location associated with a credentials acquisition device that last acquired the credentials of the first individual.

38. The system of claim 37 wherein the more particular information comprises a last badged time of first individual, wherein the last badged time comprises the time at which the last badged location was acquired.

39. The system of claim 25 wherein the method further comprises providing a third counting element on the display indicating a total number of the tracked individuals in an area group comprising the first and second areas.

40. The system of claim 39 wherein the third counting element overlaps at least part of the area group.

41. The system of claim 40 wherein the third counting element overlaps all of the areas comprising the area group.

42. The system of claim 39 wherein the access controller is further configured to:

acquire the credentials of a third individual who is one of the tracked individuals ("acquired credentials") using a third credentials acquisition device associated with a third location; and determine whether the third individual has committed an anti-passback violation in association with the third location.

43. The system of claim 42 wherein the access controller, to determine whether the anti-passback violation has been committed, is further configured to:

determine whether the acquired credentials have been used to access the third location two successive times that are separated by less than an anti-passback time limit; and when the acquired credentials have been used to access the third location two successive times that are separated by less than the anti-passback time limit, determine that the anti-passback violation has been committed.

44. The system of claim 42 wherein the access controller, to determine whether the anti-passback violation has been committed, is further configured to:

determine whether the acquired credentials have been used to access the third location two successive times; and when the acquired credentials have been used to access the third location two successive times, determine that the anti-passback violation has been committed.

45. The system of claim 42 wherein the access controller, to determine whether the anti-passback violation has been committed, is further configured to:

determine whether the acquired credentials have been used to access and to subsequently exit the third location, and whether the acquired credentials have not been used to re-enter the third location since being used to exit the first location; and when the acquired credentials have not been used to access and to subsequently exit the third location, and when the acquired credentials have not been used to re-enter the third location since being used to exit the location, determine that the anti-passback violation has been committed.

46. The system of claim 42 wherein the third location is accessible via an access point from the first location, and wherein the access controller is further configured to, when the anti-passback violation has been determined to have been committed, prevent the third individual from entering the third location from the first location via the access point.

47. The system of claim 46 wherein the access controller is communicative with a client, and in response to a request from the client to de-muster the third individual, de-musters the third individual by permitting the third individual to enter the third location from the first location via the access point notwithstanding the anti-passback violation.

48. The system of claim 47 wherein the access controller is further configured to decrement the first counting element by one.

49. A non-transitory computer readable medium having encoded thereon computer program code that, when executed by a controller, causes the controller to perform a method for tracking at least first and second individuals, the method comprising:

retrieving a first location of the first individual, wherein the first location is associated with a first credentials acquisition device that has acquired credentials of the first individual;

retrieving a second location of the second individual, wherein the second location is associated with a second credentials acquisition device that has acquired credentials of the second individual;

providing a map on a display that includes at least first and second different areas within which are situated the first and second locations respectively; and providing first and second counting elements on the display, the first and second counting elements indicating numbers of tracked individuals in the first and second areas respectively.

* * * * *